US007743543B2

(12) United States Patent
Karagias

(10) Patent No.: US 7,743,543 B2
(45) Date of Patent: Jun. 29, 2010

(54) TRIGGER MECHANISM AND A FIREARM CONTAINING THE SAME

(76) Inventor: Theodore Karagias, 433 N. 141st St., Seattle, WA (US) 98133

( * ) Notice: Subject to any disclaimer, the term of this patent is extended or adjusted under 35 U.S.C. 154(b) by 1055 days.

(21) Appl. No.: 11/244,585

(22) Filed: Oct. 6, 2005

(65) Prior Publication Data

US 2007/0245615 A1 Oct. 25, 2007

(51) Int. Cl.
*F41A 3/00* (2006.01)

(52) U.S. Cl. ..... 42/69.02; 42/16; 42/25

(58) Field of Classification Search ..... 42/69.01, 42/69.02, 14, 16, 25

See application file for complete search history.

(56) References Cited

U.S. PATENT DOCUMENTS

| | | | | |
|---|---|---|---|---|
| 2,484,977 | A | 10/1949 | Wilcox | |
| 2,514,981 | A | 7/1950 | Walker et al | |
| 2,558,872 | A * | 7/1951 | Miller | 42/69.02 |
| 3,610,714 | A | 10/1971 | DeGaeta | |
| 3,939,679 | A | 2/1976 | Barker et al. | |
| 3,949,508 | A * | 4/1976 | Elkas | 42/69.03 |
| 3,950,876 | A | 4/1976 | Wild et al. | |
| 3,951,038 | A | 4/1976 | Van Langenhoven | |
| 3,951,126 | A | 4/1976 | Rau | |
| 3,955,300 | A | 5/1976 | Folsom et al. | |
| 3,955,469 | A | 5/1976 | Conley | |
| 3,956,967 | A | 5/1976 | Martz | |
| 3,958,549 | A | 5/1976 | Johansson et al. | |
| 3,960,053 | A | 6/1976 | Conley | |
| 3,964,368 | A | 6/1976 | Zimeri Safie | |
| 3,979,849 | A | 9/1976 | Haskins | |
| 3,983,270 | A | 9/1976 | Licari et al. | |
| 3,985,060 | A | 10/1976 | Conley | |
| 3,988,849 | A | 11/1976 | Connellan et al. | |
| 3,996,686 | A | 12/1976 | Baker | |
| 3,999,461 | A | 12/1976 | Johnson et al. | |
| 4,000,575 | A | 1/1977 | Ruger et al. | |
| 4,002,156 | A | 1/1977 | Fischer | |
| 4,003,152 | A | 1/1977 | Barker et al. | |
| 4,004,364 | A | 1/1977 | Chatigny | |
| 4,004,496 | A | 1/1977 | Snodgrass et al. | |
| 4,011,790 | A | 3/1977 | Folsom et al. | |

(Continued)

FOREIGN PATENT DOCUMENTS

DE 4125148 A1 * 2/1993

OTHER PUBLICATIONS

Metcalf, D., "Innovative, Remarkable, Reliable . . . Getting Inside Savage's Accutrigger", Long Gun Reviews, http://www.shootingtimes.com/longgun_reviews/savage_0813/, retrieved from the Internet on Jun. 6, 2005.

(Continued)

*Primary Examiner*—J. Woodrow Eldred
*Assistant Examiner*—Gabriel J Klein
(74) *Attorney, Agent, or Firm*—Seed Intellectual Property Law Group PLLC

(57) ABSTRACT

A firearm having a small trigger pull force, small trigger pull distance, and a large sear engagement is provided. The firearm of the present invention provides a safe firearm having a light and crisp trigger pull. Certain embodiments of the present invention may provide a firearm having a ratio of sear engagement to trigger pull distance that is greater than or equal to 1.0.

27 Claims, 36 Drawing Sheets

U.S. PATENT DOCUMENTS

| | | | |
|---|---|---|---|
| 4,014,247 | A | 3/1977 | Tollinger |
| 4,016,668 | A | 4/1977 | Frazier |
| 4,016,669 | A | 4/1977 | Gminder |
| 4,019,480 | A | 4/1977 | Kenaio |
| 4,024,792 | A | 5/1977 | Moller |
| 4,031,840 | A | 6/1977 | Boisrayon et al. |
| 4,048,901 | A | 9/1977 | Ghisoni |
| 4,052,926 | A | 10/1977 | Tollinger |
| 4,058,924 | A | 11/1977 | Mullner |
| 4,065,867 | A | 1/1978 | Storey |
| 4,066,000 | A | 1/1978 | Rostocil |
| 4,069,702 | A | 1/1978 | Hayner |
| 4,103,586 | A | 8/1978 | Tollinger |
| 4,105,030 | A | 8/1978 | Kercso |
| 4,122,621 | A | 10/1978 | Barr |
| 4,123,963 | A | 11/1978 | Junker |
| 4,138,789 | A | 2/1979 | Langsford |
| 4,141,274 | A | 2/1979 | Gerber |
| 4,143,636 | A | 3/1979 | Liepins et al. |
| 4,150,656 | A | 4/1979 | Curran |
| 4,151,670 | A | 5/1979 | Rath |
| 4,151,782 | A | 5/1979 | Allen |
| 4,158,926 | A | 6/1979 | Kordas, Jr. et al. |
| 4,161,904 | A | 7/1979 | Groen et al. |
| 4,163,334 | A | 8/1979 | Tollinger |
| 4,164,929 | A | 8/1979 | Liepins et al. |
| 4,173,964 | A | 11/1979 | Curran |
| 4,185,537 | A | 1/1980 | Hayashi |
| 4,194,846 | A | 3/1980 | Zerillo |
| 4,200,028 | A | 4/1980 | Bains |
| 4,227,439 | A | 10/1980 | Gillum |
| 4,232,583 | A | 11/1980 | Harrison |
| 4,245,418 | A | 1/1981 | Kennedy |
| 4,257,310 | A | 3/1981 | Folsom et al. |
| 4,266,358 | A | 5/1981 | Phillips et al. |
| 4,269,386 | A | 5/1981 | Crowe |
| 4,275,640 | A | 6/1981 | Wilhelm |
| 4,282,796 | A | 8/1981 | Stoner et al. |
| 4,296,564 | A | 10/1981 | Oberst |
| 4,301,609 | A | 11/1981 | Peterson et al. |
| 4,301,709 | A | 11/1981 | Bohorquez et al. |
| 4,305,218 | A | 12/1981 | Godsey |
| 4,305,326 | A | 12/1981 | Sallach et al. |
| 4,308,786 | A | 1/1982 | Hayashi |
| 4,316,341 | A | 2/1982 | Landry |
| 4,321,764 | A | 3/1982 | Wilhelm |
| 4,328,737 | A | 5/1982 | Nelson et al. |
| 4,329,803 | A | 5/1982 | Johnson et al. |
| 4,335,643 | A | 6/1982 | Gal |
| 4,336,743 | A | 6/1982 | Horn et al. |
| 4,352,317 | A | 10/1982 | Wilhelm |
| 4,357,888 | A | 11/1982 | Phillips et al. |
| 4,358,985 | A | 11/1982 | Hamilton |
| 4,358,986 | A | 11/1982 | Giorgio |
| 4,358,987 | A | 11/1982 | Wilhelm |
| 4,361,975 | A | 12/1982 | Wilhelm |
| 4,362,397 | A | 12/1982 | Klingenberg |
| 4,378,614 | A | 4/1983 | McKenney |
| 4,383,383 | A | 5/1983 | Landry |
| 4,387,524 | A | 6/1983 | Brint et al. |
| 4,395,938 | A | 8/1983 | Curtis |
| 4,400,900 | A | 8/1983 | Hillberg et al. |
| 4,400,901 | A | 8/1983 | Hillberg |
| 4,407,085 | A | 10/1983 | Hillberg et al. |
| 4,416,186 | A | 11/1983 | Sullivan |
| 4,422,254 | A | 12/1983 | McQueen |
| 4,424,735 | A | 1/1984 | Bacon et al. |
| 4,445,292 | A | 5/1984 | Martin |
| 4,449,312 | A | 5/1984 | Ruger et al. |
| 4,450,751 | A | 5/1984 | Thevis |
| 4,452,001 | A | 6/1984 | Compton |
| 4,453,329 | A | 6/1984 | Brint et al. |
| 4,455,919 | A | 6/1984 | Osborne et al. |
| 4,459,849 | A | 7/1984 | Calamera |
| 4,462,179 | A | 7/1984 | Rogak et al. |
| 4,463,654 | A | 8/1984 | Barnes et al. |
| 4,466,417 | A | 8/1984 | Mulot et al. |
| 4,467,698 | A | 8/1984 | Perrine |
| 4,468,876 | A | 9/1984 | Ghisoni |
| 4,468,877 | A | 9/1984 | Karvonen |
| 4,469,006 | A | 9/1984 | Teppa |
| 4,471,549 | A | 9/1984 | Brint et al. |
| 4,475,437 | A | 10/1984 | Sullivan |
| 4,481,859 | A | 11/1984 | Dix |
| 4,492,145 | A | 1/1985 | Curtis |
| 4,494,439 | A | 1/1985 | Sawyer |
| 4,499,684 | A | 2/1985 | Repa |
| 4,502,367 | A | 3/1985 | Sullivan |
| 4,505,182 | A | 3/1985 | Sullivan |
| 4,512,236 | A | 4/1985 | Thevis et al. |
| 4,515,064 | A | 5/1985 | Hohrein |
| 4,522,105 | A | 6/1985 | Atchisson |
| 4,522,106 | A | 6/1985 | Sullivan |
| 4,523,510 | A | 6/1985 | Wilhelm |
| 4,531,444 | A | 7/1985 | Jackson |
| 4,532,852 | A | 8/1985 | Hance et al. |
| 4,551,936 | A | 11/1985 | Chauvet |
| 4,553,468 | A | 11/1985 | Castellano et al. |
| 4,553,469 | A | 11/1985 | Atchisson |
| 4,555,205 | A | 11/1985 | Hiroyasu et al. |
| 4,563,936 | A | 1/1986 | Cleary et al. |
| 4,563,937 | A | 1/1986 | White |
| 4,569,145 | A | 2/1986 | Ruger et al. |
| 4,570,369 | A | 2/1986 | Gerfen |
| 4,579,034 | A | 4/1986 | Holloway |
| 4,587,879 | A | 5/1986 | Savioli |
| 4,589,326 | A | 5/1986 | Kuckens et al. |
| 4,589,327 | A | 5/1986 | Smith |
| 4,590,697 | A | 5/1986 | Ruger et al. |
| 4,597,211 | A | 7/1986 | Miles |
| 4,648,190 | A | 3/1987 | Allen |
| 4,654,993 | A | 4/1987 | Atchisson |
| 4,656,919 | A | 4/1987 | Farinacci et al. |
| 4,664,015 | A | 5/1987 | Kennedy |
| 4,665,793 | A | 5/1987 | Cleary et al. |
| 4,671,005 | A | 6/1987 | Jewell |
| 4,672,761 | A | 6/1987 | Hart |
| 4,672,762 | A | 6/1987 | Nilsson |
| 4,677,897 | A | 7/1987 | Barrett |
| 4,680,884 | A | 7/1987 | Smith, Jr. et al. |
| 4,693,170 | A | 9/1987 | Atchisson |
| 4,700,608 | A | 10/1987 | Pettinga et al. |
| 4,709,617 | A | 12/1987 | Anderson |
| 4,709,686 | A | 12/1987 | Taylor et al. |
| 4,719,841 | A | 1/1988 | Perrine |
| 4,723,369 | A | 2/1988 | Badali |
| 4,727,670 | A | 3/1988 | Krouse |
| 4,732,074 | A | 3/1988 | Normand |
| 4,754,567 | A | 7/1988 | Lehfeldt et al. |
| 4,774,929 | A | 10/1988 | Milliman |
| 4,787,288 | A | 11/1988 | Miller |
| 4,791,851 | A | 12/1988 | Stoner |
| 4,791,908 | A | 12/1988 | Pellis |
| 4,821,621 | A | 4/1989 | Lorenzo |
| 4,856,410 | A | 8/1989 | Anderson |
| 4,867,040 | A | 9/1989 | Barrett |
| 4,870,770 | A | 10/1989 | Forbes et al. |
| 4,872,391 | A | 10/1989 | Stoner |
| 4,874,367 | A | 10/1989 | Edwards |
| 4,879,827 | A | 11/1989 | Gentry |
| 4,881,517 | A | 11/1989 | Wackrow et al. |
| 4,890,405 | A | 1/1990 | Krouse |
| 4,893,545 | A | 1/1990 | Sanderson et al. |
| 4,893,547 | A | 1/1990 | Atchisson |

4,897,949 A 2/1990 Whiteing
4,908,970 A 3/1990 Bell
4,920,677 A 5/1990 Schuerman
4,926,574 A 5/1990 Rieger
4,930,399 A 6/1990 Trevor, Jr.
4,937,964 A 7/1990 Crandall
4,938,116 A 7/1990 Royster
4,966,063 A 10/1990 Sanderson et al.
4,974,499 A 12/1990 Sanderson et al.
4,977,815 A 12/1990 Stephens
4,987,693 A 1/1991 Brooks
4,989,357 A 2/1991 Norman et al.
5,012,604 A 5/1991 Rogers
5,018,292 A 5/1991 West
5,024,138 A 6/1991 Sanderson et al.
5,024,139 A 6/1991 Knight, Jr. et al.
5,035,692 A 7/1991 Lyon et al.
5,050,480 A 9/1991 Knight, Jr. et al.
5,050,481 A 9/1991 Knight, Jr. et al.
5,054,365 A 10/1991 Wissing
5,065,662 A 11/1991 Bullis et al.
5,067,266 A 11/1991 Findlay
5,073,165 A 12/1991 Edwards
5,078,043 A 1/1992 Stephens
5,081,780 A 1/1992 Lishness et al.
5,086,578 A 2/1992 Lishness et al.
5,105,570 A 4/1992 Lishness et al.
5,127,310 A 7/1992 Lishness et al.
5,133,331 A 7/1992 Hutchinson
5,155,292 A 10/1992 Rostcil et al.
5,157,209 A 10/1992 Dunn
5,161,516 A 11/1992 Ekstrom
5,164,534 A 11/1992 Royster
5,229,539 A 7/1993 Rommel
5,259,138 A 11/1993 Scirica
5,280,778 A 1/1994 Kotsiopoulos
5,299,722 A 4/1994 Cheney
5,308,945 A 5/1994 Van Handel et al.
5,325,760 A 7/1994 Dennis
5,329,685 A 7/1994 Gillespie
5,349,938 A 9/1994 Farrell
5,357,939 A 10/1994 Tentler et al.
5,359,921 A 11/1994 Wolff et al.
5,363,581 A 11/1994 Blenk et al.
5,370,036 A 12/1994 Stoner
5,383,389 A 1/1995 Wolff et al.
5,410,135 A 4/1995 Pollart et al.
5,413,083 A 5/1995 Jones
5,440,963 A 8/1995 Szecsei
5,458,046 A 10/1995 Blenk et al.
5,469,853 A 11/1995 Law et al.
5,484,092 A 1/1996 Cheney
5,487,233 A 1/1996 Jewell
5,497,758 A 3/1996 Dobbins et al.
5,509,399 A 4/1996 Poor
5,515,838 A 5/1996 Anderson
5,522,374 A 6/1996 Clayton
5,551,180 A 9/1996 Findlay et al.
5,558,077 A 9/1996 Linsmeyer
5,572,982 A 11/1996 Williams
5,585,590 A 12/1996 Ducolon
5,586,545 A 12/1996 McCaslin
5,615,662 A 4/1997 Tentler et al.
5,649,520 A 7/1997 Bednar
5,653,051 A 8/1997 Pons et al.
5,653,213 A 8/1997 Linsmeyer
5,659,992 A 8/1997 Mistretta
5,673,505 A 10/1997 Phillips
5,673,679 A 10/1997 Walters
5,680,853 A 10/1997 Clayton
5,682,699 A 11/1997 Gentry
5,691,497 A 11/1997 Weichert et al.
5,701,878 A 12/1997 Moore et al.
5,704,342 A 1/1998 Gibson et al.
5,718,074 A 2/1998 Keeney
5,722,193 A 3/1998 Post
5,722,383 A 3/1998 Tippmann, Sr. et al.
5,724,759 A 3/1998 Kilham
5,726,377 A 3/1998 Harris et al.
5,736,667 A 4/1998 Munostes et al.
5,743,039 A 4/1998 Garrett
5,770,814 A 6/1998 Ealovega
5,771,875 A 6/1998 Sullivan
5,783,753 A 7/1998 Kellerman
5,784,818 A 7/1998 Otteson
5,787,629 A 8/1998 Campbell et al.
5,813,158 A 9/1998 Campbell et al.
5,826,362 A 10/1998 Lyons
5,827,992 A 10/1998 Harris et al.
5,857,280 A 1/1999 Jewell
5,878,736 A 3/1999 Lotuaco, III
5,913,303 A 6/1999 Kotsiopoulos
5,915,934 A 6/1999 Knight et al.
5,939,657 A 8/1999 Morgado
5,954,043 A 9/1999 Mayville et al.
5,974,940 A 11/1999 Madni et al.
6,024,077 A 2/2000 Kotsiopoulos
6,065,460 A 5/2000 Lotuaco, III
6,070,352 A 6/2000 Daigle
6,073,380 A 6/2000 Hauser et al.
6,101,918 A 8/2000 Akins
6,131,324 A 10/2000 Jewell
6,142,058 A 11/2000 Mayville et al.
6,164,001 A 12/2000 Lee
6,176,169 B1 1/2001 Rostocil
6,189,253 B1 2/2001 Knight et al.
6,205,990 B1 3/2001 Adkins
6,209,249 B1 4/2001 Borden
6,226,915 B1 5/2001 Kotsiopoulos
6,234,058 B1 5/2001 Morgado
6,263,776 B1 7/2001 Rostocil
6,345,461 B1 2/2002 Constant et al.
6,345,462 B1 2/2002 Mikuta et al.
6,345,463 B1 2/2002 Baer, Sr.
6,354,320 B1 3/2002 Kolacz et al.
6,360,467 B1 3/2002 Knight
6,360,468 B1 3/2002 Constant et al.
6,360,469 B1 3/2002 Mikuta et al.
6,360,470 B1 3/2002 Constant et al.
6,401,378 B1 6/2002 Ockenfuss
6,401,592 B1 6/2002 Rostocil
6,403,602 B1 6/2002 Crooks et al.
6,412,206 B1 7/2002 Strayer
6,412,208 B1 7/2002 Mikuta et al.
6,425,386 B1 7/2002 Adkins
6,432,559 B1 8/2002 Tompkins et al.
6,460,281 B1 10/2002 Schaeffer
6,470,872 B1 10/2002 Tiberius et al.
6,477,802 B2 11/2002 Baer, Sr.
6,516,791 B2 2/2003 Perrone
6,520,172 B2 2/2003 Perrone
6,530,305 B1 3/2003 MacLeod et al.
6,553,706 B1 4/2003 Gancarz et al.
6,560,909 B2 5/2003 Cominolli
6,631,709 B2 10/2003 Carter et al.
6,634,129 B1 10/2003 Freeman, Jr.
6,650,669 B1 11/2003 Adkins
6,668,478 B2 12/2003 Bergstrom
6,681,511 B1 1/2004 Huber
6,698,918 B2 3/2004 Durand
6,701,909 B2 3/2004 Tiberius et al.
6,708,685 B2 3/2004 Masse
6,718,680 B2 4/2004 Roca et al.
6,722,072 B1 4/2004 McCormick
6,729,322 B2 5/2004 Schavone
6,735,897 B1 5/2004 Schmitter et al.

| | | | |
|---|---|---|---|
| 6,760,991 | B1 | 7/2004 | Gentry |
| 6,782,791 | B2 | 8/2004 | Moore |
| 6,789,342 | B2 | 9/2004 | Wonisch et al. |
| 6,796,067 | B2 | 9/2004 | Popikow |
| 6,820,533 | B2 | 11/2004 | Schuerman |
| 6,820,608 | B2 | 11/2004 | Schavone |
| 6,832,605 | B2 | 12/2004 | Farrell |
| 6,874,492 | B1 | 4/2005 | Schavone |
| 6,892,718 | B2 | 5/2005 | Tiberius et al. |
| 6,901,689 | B1 | 6/2005 | Bergstrom |
| 6,907,687 | B2 | 6/2005 | Rousseau et al. |
| 6,907,813 | B2 | 6/2005 | Gablowski |
| 6,919,111 | B2 | 7/2005 | Swoboda et al. |
| 6,948,273 | B2 | 9/2005 | Baker |
| 7,181,680 | B2 | 2/2007 | Keeney |
| 7,555,900 | B1 | 7/2009 | Vallance et al. |
| 2002/0071349 | A1 | 6/2002 | Durand |
| 2002/0153982 | A1 | 10/2002 | Jones et al. |
| 2007/0116546 | A1 | 5/2007 | Dearing |

OTHER PUBLICATIONS

Quinn, J., "Savage Arms' New AccuTrigger", from http://www.gunblast.com/Savage_AccuTrigger.htm, Dec. 28, 2002.

Election/Restriction Requirement mailed on Feb. 24, 2009 from continuation-in-part U.S. Appl. No. 11/405,915, filed on Apr. 18, 2006, 6 pages.

"Anschutz match-trigger," Oct. 2, 1999, URL=http://web.archive.org/web/19991002082053/http:www.championshooters.com/trigger.htm, retrieved on May 18, 2009, 1 page.

Office Action mailed on Jul. 15, 2009 from continuation-in-part U.S. Appl. No. 11/405,915, filed Apr. 18, 2006, 13 pages.

* cited by examiner

TRIGGER MECHANISM AND A FIREARM CONTAINING THE SAME

BACKGROUND OF THE INVENTION

1. Field of the Invention

The present invention generally relates to a trigger mechanism and a firearm containing the same. More particularly, the present invention is directed towards a trigger mechanism and a firearm that is safe and has a lightweight and short trigger pull.

2. Description of the Prior Art

Various types of firearms can be categorized according to various different characteristics of the firearms. For example, firearms arms can be classified according to the different trigger designs.

Most military or competitive shooters appear to have adopted a trigger design called a two-stage trigger. A two-stage trigger is designed so that when the shooter "squeezes" the trigger (i.e. exert a force with his/her finger on a "trigger shoe"), there is an immediate and relatively large displacement of the trigger shoe (i.e. the first stage). This is followed by an abrupt and definitive stop and is referred to as a first stage. At this point, an additional force is gradually applied until (a sudden) discharge occurs (i.e. the second stage). Thus, a two-stage trigger is characterized by a light squeeze that takes up an initial slack, followed by an additional squeeze, which leads to a sudden release of the firing mechanism.

In contrast, most hunters or casual shooters appear to prefer a single stage trigger. A single stage trigger is designed so that upon squeezing the trigger, perceptible displacement of the trigger does not take place until the discharge of the firearm. Thus, the single stage trigger is characterized by a gradually applied squeeze followed by the sudden release of the firing mechanism.

Regardless of which trigger designs are employed, important functional goals of a high quality trigger mechanism design include, to name a few, safety, lightweight trigger pull, nearly imperceptible movement of the trigger shoe during discharge, and a "crisp" feel during discharge. For example, lightweight trigger pull is desired so that the position of the firearm will not be influenced during discharge of the firearm (i.e. for accuracy). Safety is a major concern so that accidental (unintentional) discharge of the firearm is prevented.

Obtaining a lightweight trigger while maintaining safety has been difficult. As such, trigger mechanism designs traditionally employed a trade-off strategy wherein heavy trigger pull was employed to prevent accidental discharge of the firearm.

Most trigger mechanisms incorporate a sear. A sear is typically characterized by two hardened steel components engaging (bearing upon) one another to maintain the trigger mechanism in a set configuration. Typically, the engagement of the two sear components is characterized by a slight overlap with each other to obstruct motion until a trigger is pulled. Upon pulling the trigger, these two components are designed to disengage in order to allow discharge of the firearm.

In the two-stage trigger design, a relatively large sear engagement of about 1.5 mm can be employed. (Sear engagement is the overlap of the two sear components, wherein in the present invention, the two sear components are a sear and a sear catch.) However, the relatively large displacement of the trigger in the first stage causes the sear to become almost completely disengaged, so that a nearly imperceptible movement of the trigger and a "crisp" feel can be obtained during the second stage.

In the single-stage trigger design, sear engagement is on the order of 0.25-0.38 mm, which is only about 3-5 times more than the diameter of human hair. Such small or slight sear engagement is provided so that a "crisp" feel can be provided during discharge. As such, these firearms rely heavily on their safety mechanisms and stiff springs to maintain sear engagement.

However, certain problems exist with such an approach. The surfaces and edges of the two hardened steel components of the sear can degrade over time by wear, corrosion, and additional factors. Therefore, accidental discharge of the firearm can suddenly occur without warning after prolonged use or storage, especially in a corrosive environment.

Even the presence of a safety mechanism may not be satisfactory. For example, if a safety mechanism functions so as to maintain sear engagement, sear degradation can result in an accidental discharge of the firearm regardless of whether the safety mechanism is in place or not. In addition, even if a safety mechanism of a firearm functions to obstruct the motion of the firing pin assembly independently of the sear mechanism, accidental discharge can nevertheless occur. For example, sear degradation may cause an accidental discharge to occur as soon as the safety mechanism is disengaged.

Therefore, a trigger exhibiting minimal movement, a lightweight trigger pull, and a large (and therefore safe) sear engagement before discharge would provide significant improvements.

SUMMARY OF THE INVENTION

A trigger mechanism and a firearm containing the same in accordance with the present invention overcomes the problems described above. More particularly, the present invention provides a trigger mechanism and/or a firearm that is safe, has a short and lightweight trigger pull, and has a crisp feel during discharge.

The trigger mechanism and/or the firearm containing the same in accordance with the present invention includes a trigger assembly that is composed of a trigger, a trigger roller, and a trigger spring; a firing pin assembly that is composed of a cocking piece, firing pin, firing pin spring, and a bolt shroud; and a sear assembly that is composed of a sear, a sear catch, and an element that obstructs the movement of the cocking piece until the trigger is pulled.

The trigger mechanism and/or the firearm in accordance with the present invention may also have a ratio of sear engagement to trigger pull distance greater than or equal to 0.5 and less than or equal to 10.0.

DETAILED DESCRIPTION OF THE INVENTION

The present invention will now be described more fully hereinafter, in which various embodiments of the invention are shown. This invention may, however, be embodied in many different forms and should not be construed as being limited to the embodiment explicitly set forth herein.

1. Firearm

Figure 1:
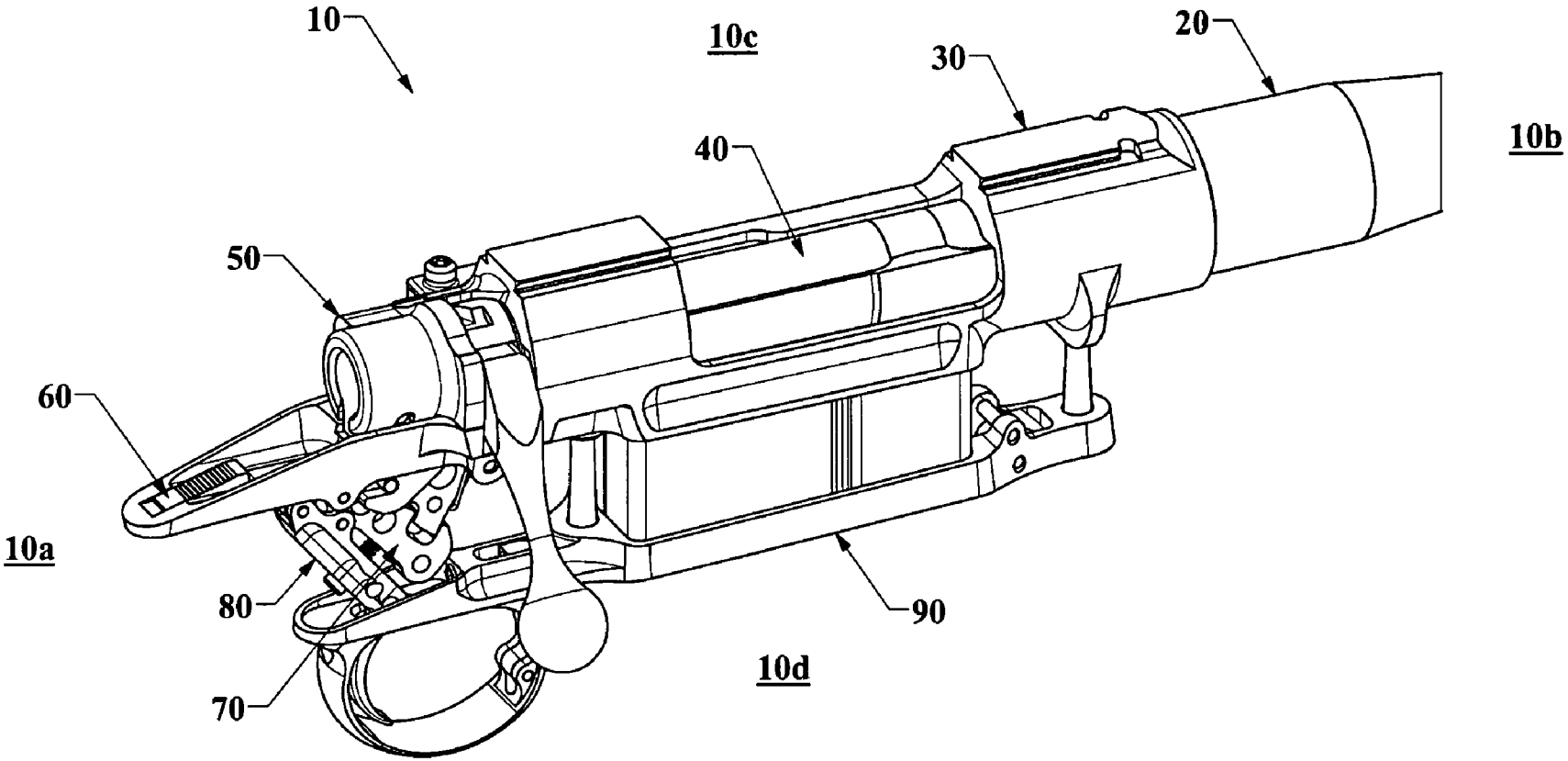
FIG. 1 is a view showing a firearm in accordance with certain embodiments of the present invention.

In accordance with certain embodiments of the present invention, FIG. 1 shows a view of a firearm 10 composed of a barrel 20, a receiver assembly 30, a bolt assembly 40, a firing pin assembly 50, a safety assembly 60, a sear assembly 70, a trigger assembly 80, and a floor plate assembly 90. Barrel 20 is connected to receiver assembly 30. Receiver assembly 30 is connected to bolt assembly 40, firing pin assembly 50, safety assembly 60, sear assembly 70, trigger assembly 80, and floor plate assembly 90. Trigger assembly 80 is connected to sear assembly 70.

As indicated in FIG. 1, a proximal end 10*a* of firearm 10 refers a region near trigger assembly 80, and the distal end 10*b* of firearm 10 refers to a region near barrel 20. A top 10*c* of firearm 10 refers to a region above receiver assembly 30 (in a direction away from trigger assembly 80) and a bottom 10*d* of firearm 10 refers to a region below trigger assembly 80.

Firearm 10 may, for example, be the Model 1 bolt-action rifle having an over center type mechanism designed by Theodore Karagias of the American Rifle Company, Inc., or any other suitable firearm.

Figure 2:
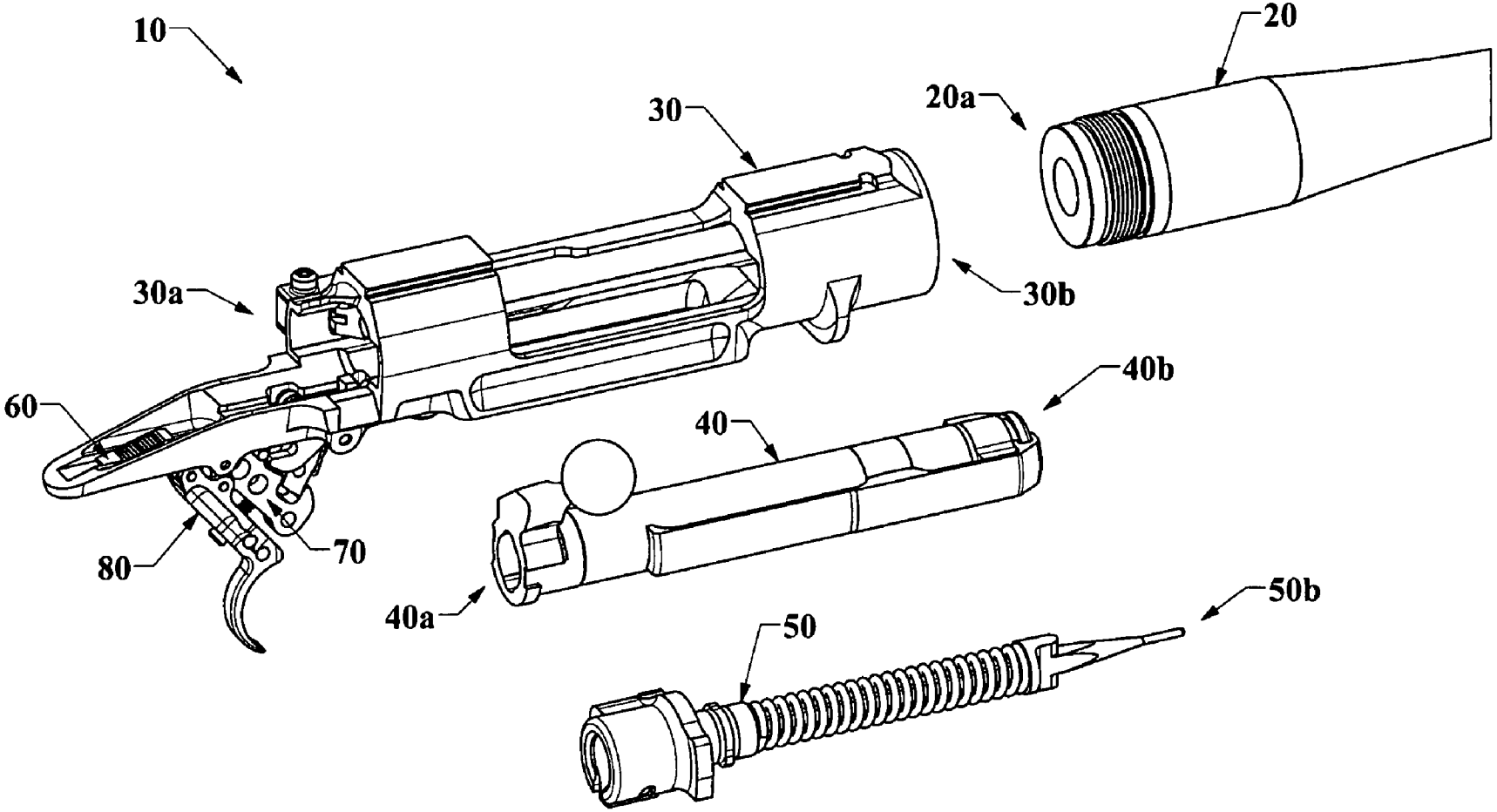
FIG. 2 is a view of several components of a firearm in accordance with certain embodiments of the present invention.

FIG. 2 shows firearm 10 disassembled into four parts, as viewed obliquely from the top and proximal end of firearm 10. The first part is barrel 20, having a proximal end 20*a*. The second part is the combination of trigger assembly 80, sear assembly 70, and receiver assembly 30, having a proximal end 30*a* and a distal end 30*b*. The third part is bolt assembly 40, having a proximal end 40*a* and a distal end 40*b*. The fourth part is firing pin assembly 50, having a distal end 50*b*.

As shown in FIG. 2, to assemble the parts as firearm 10, proximal end 20*a* of barrel 20 may mate with distal end 30*b* of receiver assembly 30. The distal end 50*b* of firing pin assembly 50 may be inserted into bolt assembly 40 via proximal end 40*a* of bolt assembly 40. Distal end 40*b* of bolt assembly 40 may be inserted into receiver assembly 30 via proximal end 30*a* of receiver assembly 30.

Figure 3A:
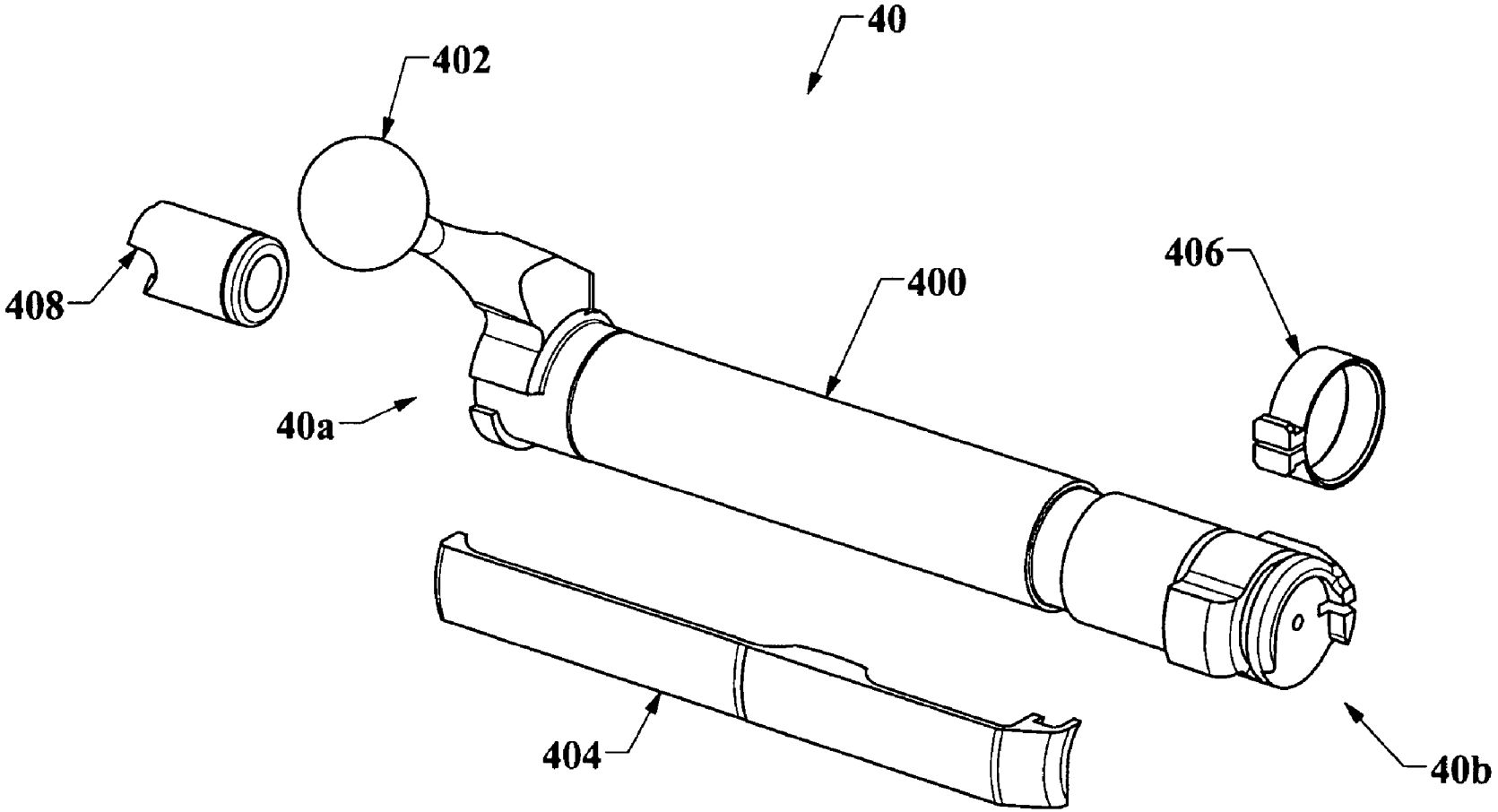
FIG. 3A is a view of a bolt assembly in accordance with certain embodiments of the present invention.
Figure 3B:
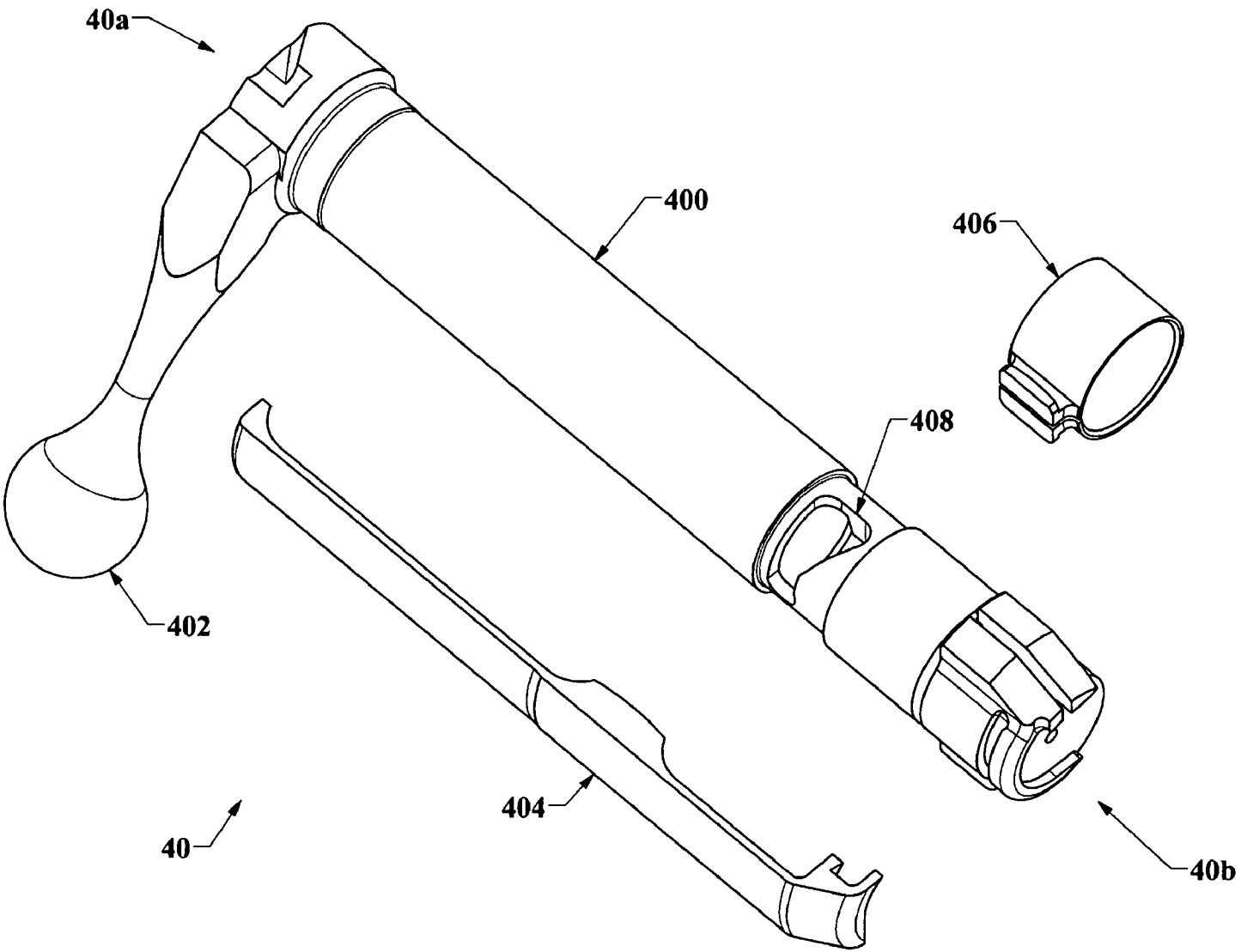
FIG. 3B is a view of a bolt assembly in accordance with certain additional embodiments of the present invention.
Figure 3C:
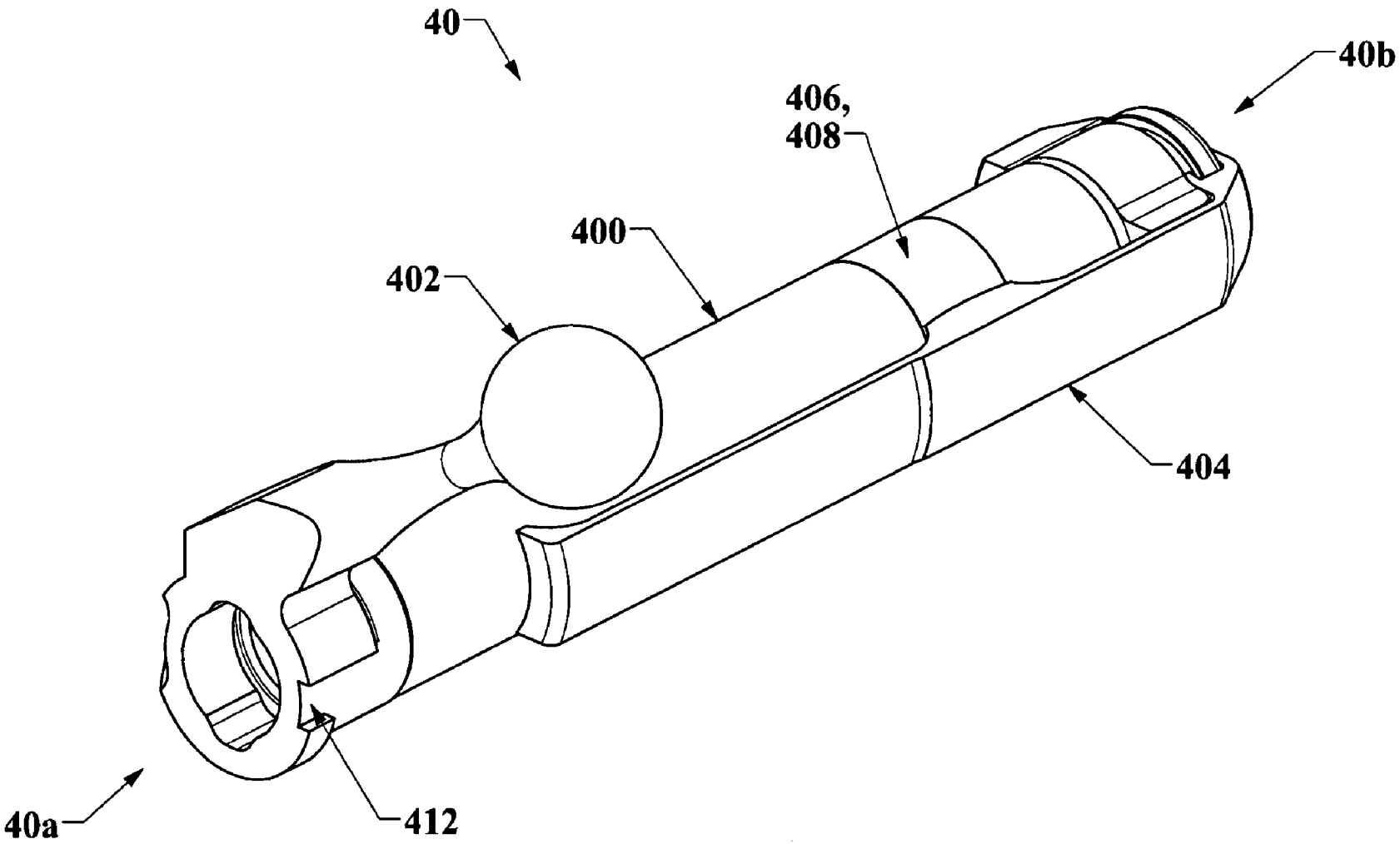
FIG. 3C is a view from a different angle of a bolt assembly in accordance with certain embodiments of the present invention.

FIGS. 3A through 3C show detailed views of bolt assembly 40 in accordance with various different embodiments of the present invention. FIG. 3A is a detailed view of bolt assembly 40 as viewed obliquely from the top and distal end of firearm 10. As shown in FIG. 3A, bolt assembly 40 is composed of a bolt 400, a bolt knob 402, an extractor 404, an extractor collar 406, and a firing pin cam 408. Although shown in FIG. 3A as separate components, firing pin cam 408 may be assembled to bolt 400 to make bolt 400 and firing pin cam 408 act as a single part. In certain embodiments, firing pin cam 408 may, for example, be press fitted to bolt 400. Firing pin cam 408 may be shaped to engage firing pin cam lugs 514, shown in FIGS. 4A and 4B and in FIGS. 12A, 12B, and 12C.

In other embodiments of the invention, bolt 400 may be formed so that firing pin cam 408 is a feature integrally machined into bolt 400 (see FIG. 3B).

FIG. 3C is a detailed view of bolt assembly 40 as viewed obliquely from the top and proximal end of firearm 10 where extractor 404 and extractor collar 406 are shown in the assembled form. As shown in FIG. 3C, firing pin cam 408 may be hidden from view by extractor collar 406. In addition, the underside of bolt 400 may be cut to form a safety lug slot 412.

Figure 4A:
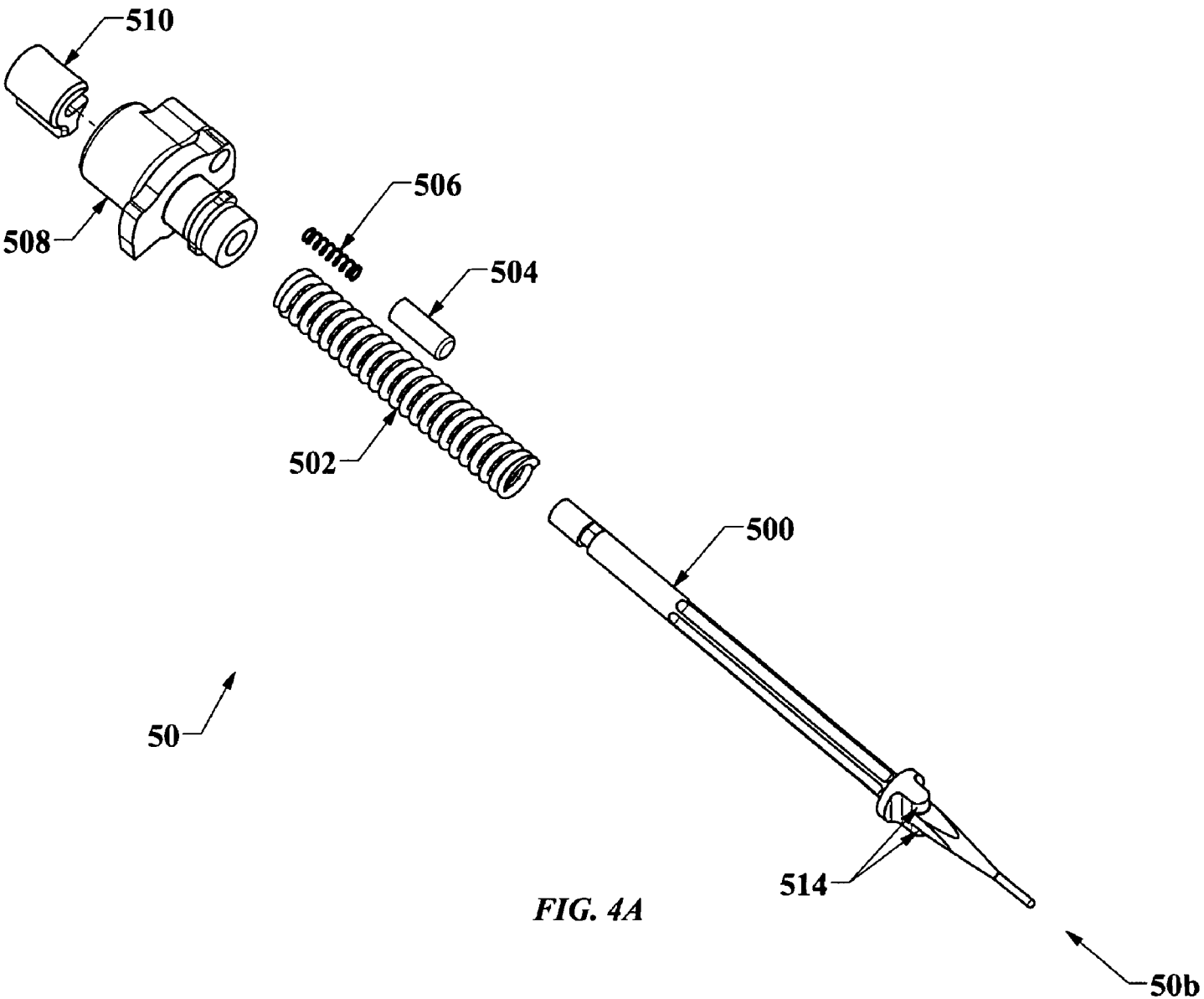
FIG. 4A is a view of a firing pin assembly in accordance with certain embodiments of the present invention.

FIG. 4A shows a detailed view of firing pin assembly 50 as viewed from the top and distal end of firearm 10. As shown, firing pin assembly 50 is composed of a firing pin 500, a firing pin spring 502, a bolt shroud locking pin 504, a bolt shroud locking pin spring 506, a bolt shroud 508, and a cocking piece 510. Firing pin 500 has a firing pin cam lug 514 which can be engaged by firing pin cam 408. The bolt shroud 508 may also be referred to as a bolt sleeve and the cocking piece 510 may also be referred to as a striker.

Figure 4B:
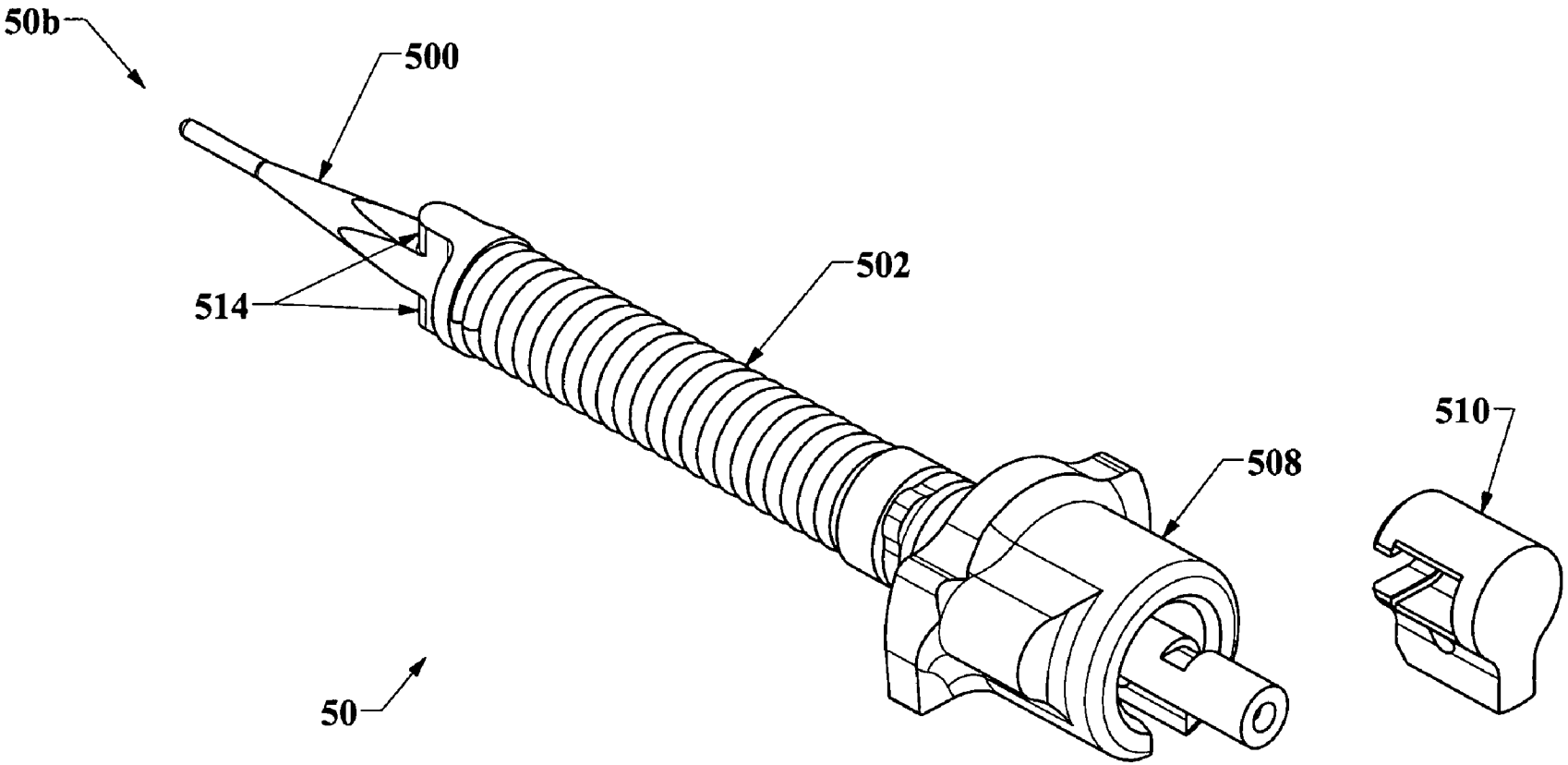
FIG. 4B is a view of a nearly assembled firing pin assembly viewed from a different angle in accordance with certain embodiments of the present invention.

FIG. 4B shows a detailed view of firing pin assembly 50 as viewed from the top and proximal end of firearm 10. FIG. 4B shows how firing pin 500, firing pin spring 502, bolt shroud locking pin 504, bolt shroud locking pin spring 506, and bolt shroud 508, and cocking piece 510 may be assembled together to form firing pin assembly 50. (Bolt shroud locking pin 504 and bolt shroud locking pin spring 506 are not visible in FIG. 4B). Cocking piece 510 inserts into bolt shroud 508 by pushing cocking piece 510 radially into engagement with firing pin 500 and then allowing firing pin 500 and cocking piece 510 to move forward (towards distal end 10*b* of firearm 10) through bolt shroud 508 until cocking piece 510 bottom out in bolt shroud 508. As previously described, distal end 50*b* of firing pin assembly 50 may be inserted into proximal end 40*a* of bolt assembly 40, as shown in FIG. 2.

Figure 5A:
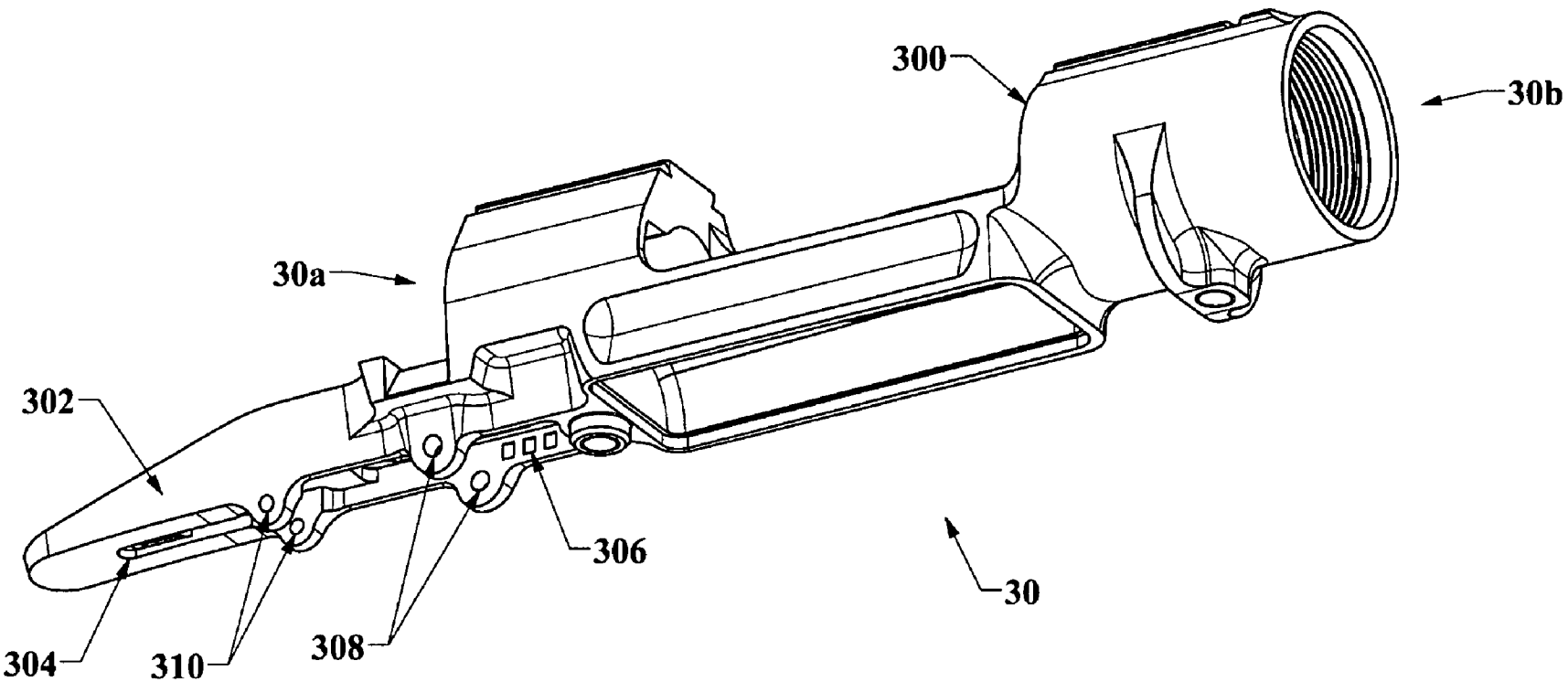
FIG. 5A is a view of a receiver assembly in accordance with certain embodiments of the present invention.
Figure 5B:
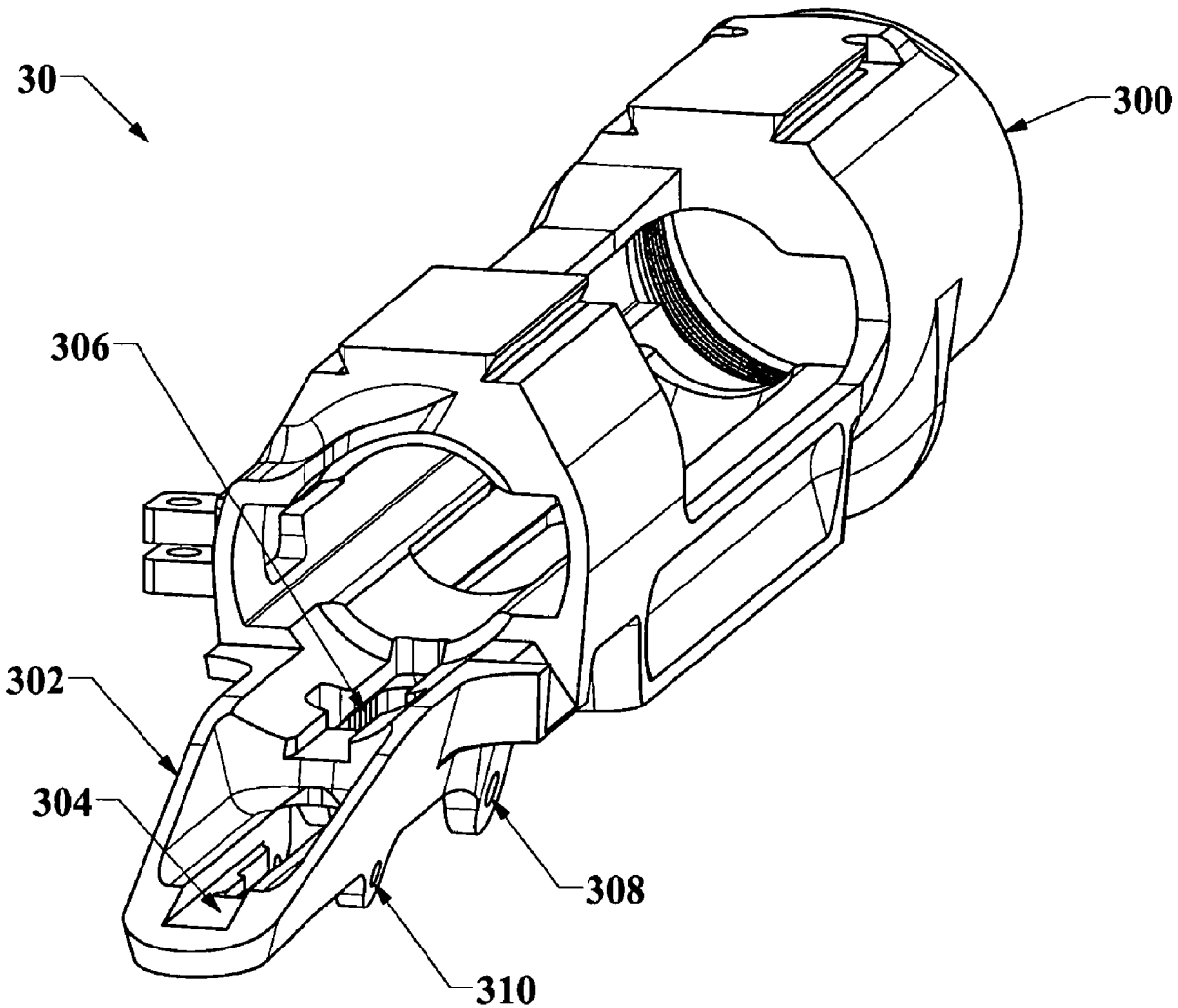
FIG. 5B is a view from a different angle of a receiver assembly in accordance with certain embodiments of the present invention.

FIGS. 5A and 5B show detailed views of receiver assembly 30. FIG. 5A is a detailed view of receiver assembly 30 as viewed obliquely from the bottom and distal end of firearm 10. FIG. 5B is a detailed view of receiver assembly 30 as viewed obliquely from the top and proximal end of firearm 10. As shown, receiver assembly 30 is composed of a receiver 300. Receiver 300 has a receiver tang 302, a safety slot 304, detents 306, receiver sear pin holes 308, and receiver sear catch pin holes 310. Safety slot 304 is more clearly visible in FIG. 5B.

Figure 6B:
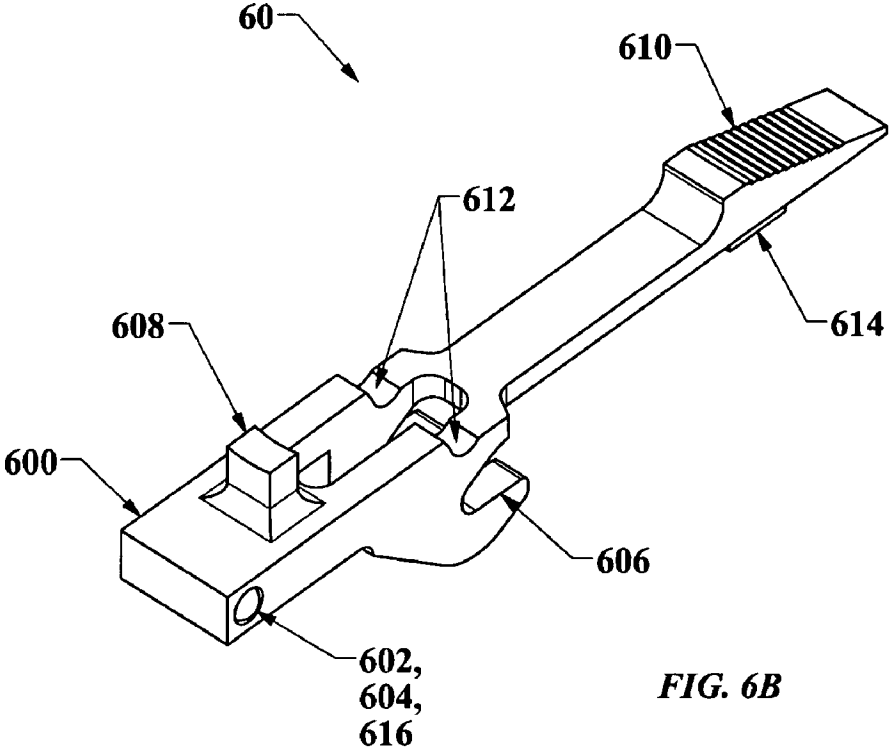
FIG. 6B is a view from a different angle of a safety assembly in accordance with certain embodiments of the present invention.
Figure 6A:
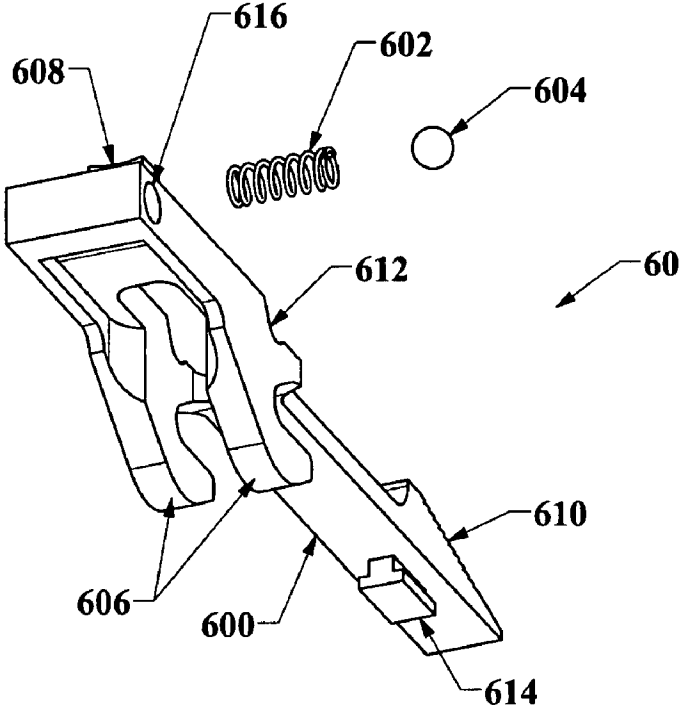
FIG. 6A is a view of a safety assembly in accordance with certain embodiments of the present invention.

FIGS. 6A and 6B show detailed views of safety assembly 60. FIG. 6A is a detailed view of safety assembly 60 as viewed obliquely from the bottom and distal end of firearm 10. FIG. 6B is a detailed view of safety assembly 60, in the assembled form, as viewed obliquely from the top and distal end of firearm 10. As shown in FIGS. 6A and 6B, safety assembly 60 is composed of a safety 600, a safety detent spring 602, and a safety detent ball 604. Safety 600 has a safety hook 606, a safety lug 608, a safety grip 610, a sear roller pin clearance cut 612, a safety/receiver engagement 614, and safety detent spring and ball hole 616. Safety lug 608 and safety grip 610 are more clearly visible in FIG. 6B. Safety detent spring 602 and safety detent ball 604 may be assembled with safety 600 via safety detent spring and ball hole 616, as shown in FIGS. 6A and 6B.

Figure 7B:
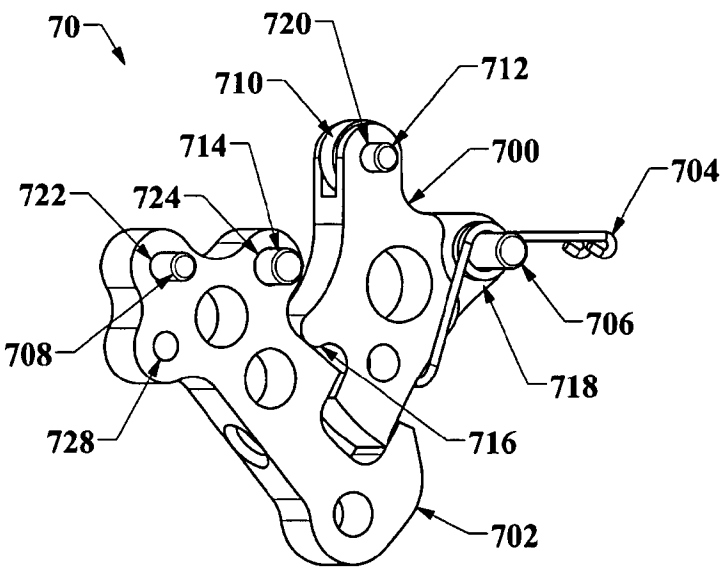
FIG. 7B is a view from a different angle of a sear assembly in accordance with certain embodiments of the present invention.
Figure 7A:
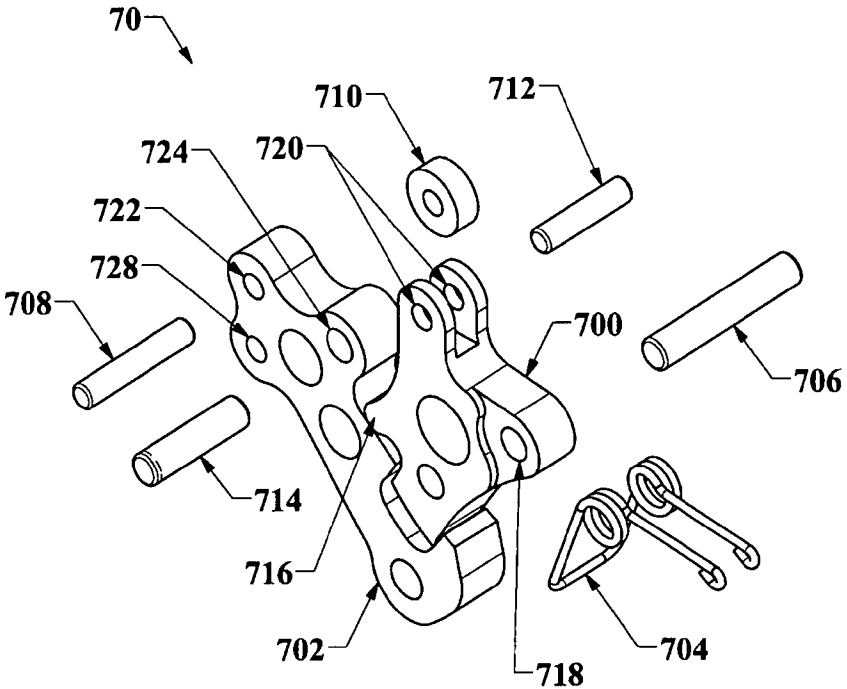
FIG. 7A is a view of a sear assembly in accordance with certain embodiments of the present invention.

FIGS. 7A and 7B are detailed views of sear assembly 70. FIG. 7A is a detailed view of sear assembly 70 as viewed obliquely from the top and distal end of firearm 10. FIG. 7B is a detailed view of sear assembly 70 as viewed obliquely from the bottom and proximal end of firearm 10. As shown in FIGS. 7A and 7B, sear assembly 70 is composed of a sear 700, a sear catch 702, a sear return spring 704, a sear pin 706, a sear catch pin 708, a sear roller 710, and a sear roller pin 712, and a sear catch safety pin 714. Sear 700 has a sear lobe 716, a sear pin hole 718, and sear roller pin holes 720. Sear catch 702 has a sear catch pin hole 722, sear catch safety pin hole 724, and sear catch trigger pin hole 728.

As shown in FIG. 7B, sear roller 710 and sear roller pin 712 may be assembled with sear 700 via sear roller pin hole 720, and sear pin 706 may be assembled with sear 700 via sear pin hole 718. Furthermore, sear catch safety pin 714 may be assembled with sear catch 702 via sear catch safety pin hole 724, and sear catch pin 708 may be assembled with sear catch 702 via sear catch pin hole 722.

Figure 8B:
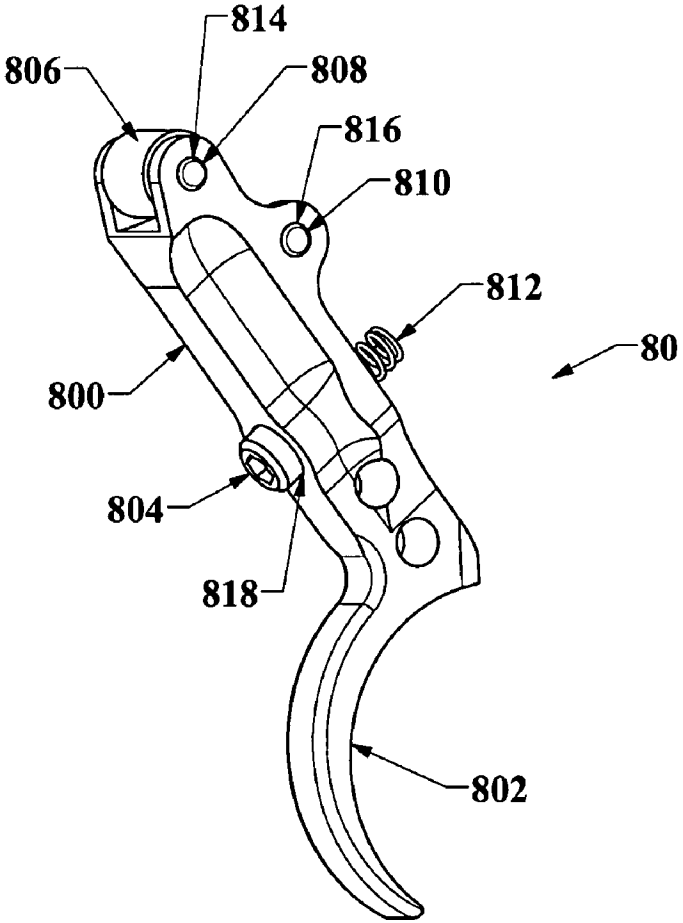
FIG. 8B is a view from a different angle of a trigger assembly in accordance with certain embodiments of the present invention.
Figure 8A:
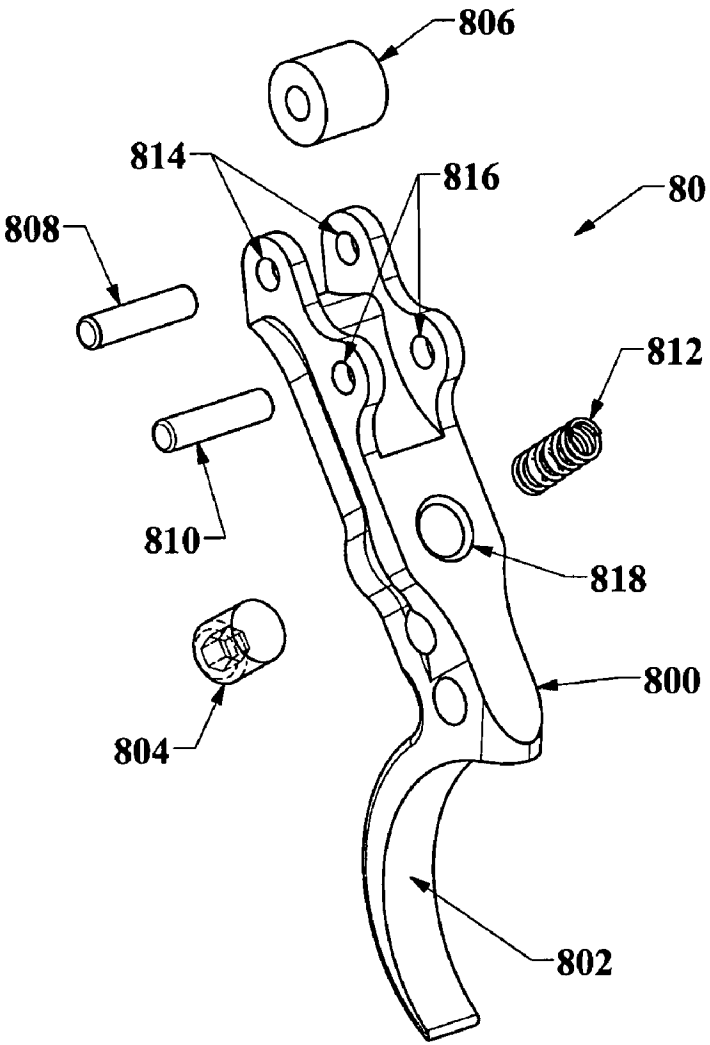
FIG. 8A is a view of a trigger assembly in accordance with certain embodiments of the present invention.

FIGS. 8A and 8B are detailed views of trigger assembly 80. FIG. 8A is a detailed view of trigger assembly 80 as viewed obliquely from the top and distal end of firearm 10. FIG. 8B is a detailed view of trigger assembly 80 as viewed obliquely from the bottom and proximal end of firearm 10. As shown, trigger assembly 80 is composed of a trigger 800, a trigger set screw 804, a trigger roller 806, a trigger roller pin 808, a trigger pin 810, and a trigger spring 812. Trigger 800 has a trigger shoe 802, a trigger roller pin holes 814, trigger pin holes 816, and trigger set screw hole 818.

Trigger roller 806 and trigger roller pin 808 may be assembled with trigger 800 via trigger roller pin hole 814, as shown in FIG. 8B. FIG. 8B also shows trigger set screw 804 may be assembled with trigger 800 via trigger set screw hole 818.

Figure 9:
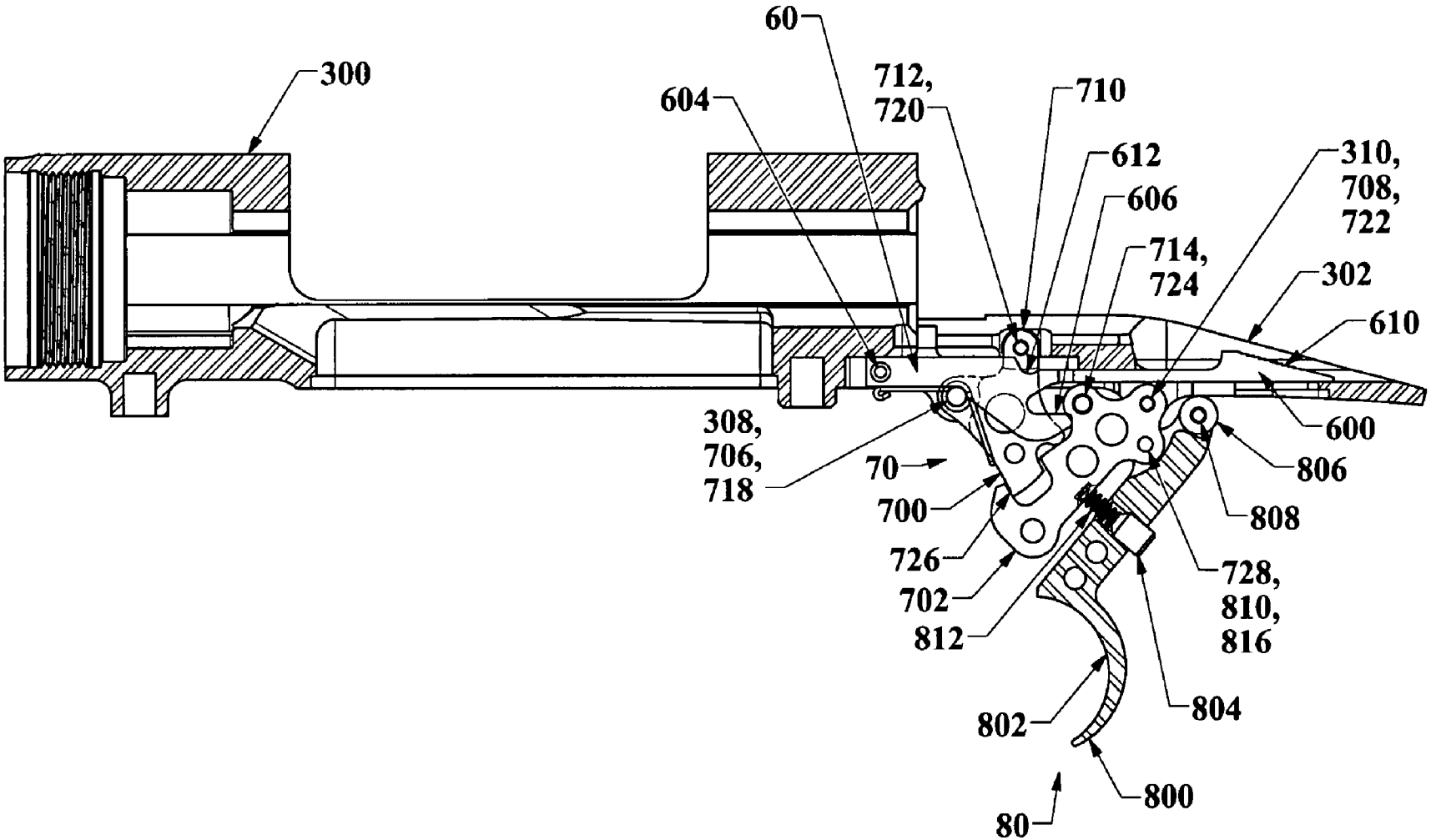
FIG. 9 is a view showing how a safety assembly, a sear assembly, and a trigger assembly may be assembled together with a receiver to obtain a partially assembled firearm in accordance with certain embodiments of the present invention.

FIG. 9 is a view showing how safety assembly 60, sear assembly 70, and trigger assembly 80 may be assembled together with receiver 300. Trigger 800 may be assembled with sear catch 702 by trigger pin 810 via sear catch trigger pin hole 728 and trigger pin hole 816. Trigger 800 is free to rotate about trigger pin 810.

Trigger roller 806 is free to rotate about trigger roller pin 808 and trigger roller 806 may touch the bottom of receiver 300.

Trigger set screw 804 may be used to capture trigger spring 812 between trigger 800 and sear catch 702 and may also be used to adjust the length of trigger spring 812.

Safety 600 may be partially housed within a slot cut into the underside of receiver 300 near receiver tang 302. Safety grip 610 may be sheltered by receiver tang 302.

Safety 600 may be a three-position type safety mechanism that can be actuated by the thumb of a shooter's shooting (trigger) hand using safety grip 610 while in the shooting position.

Safety detent ball 604 may be spring-loaded by safety detent spring 602 and may engage detents 306 machined into receiver 300 to provide tactile feedback to a shooter.

Safety hook 606 may be shaped so that it may engage with sear catch safety pin 714. Sear roller pin clearance cut 612 may be shaped so that sear roller pin 712 can drop into sear roller pin clearance cut 612.

Sear 700 may be pinned to receiver 300 by sear pin 706 via receiver sear pin holes 308 and sear pin hole 718 and may be free to rotate about sear pin 706.

Sear roller 710 may be pinned to sear 700 by sear roller pin 712 via sear roller pin hole 720 and may be free to rotate about sear roller pin 712.

Sear roller pin 712 may be attached to sear 700 via sear roller pin hole 720 and may emanate from either side of sear 700.

Sear catch 702 may be pinned to receiver 300 by sear catch pin 708 via sear catch pin hole 722 and receiver sear catch pin holes 310. Sear catch 702 is free to rotate about sear catch pin 708.

Sear 700 impinges sear catch 702 at sear interface 726. Sear catch safety pin 714 may be attached to sear catch 702 via sear catch safety pin hole 724 and emanates from either side of sear catch 702 to allow engagement by safety hook 606.

2. Firing Sequence

Figure 10A:
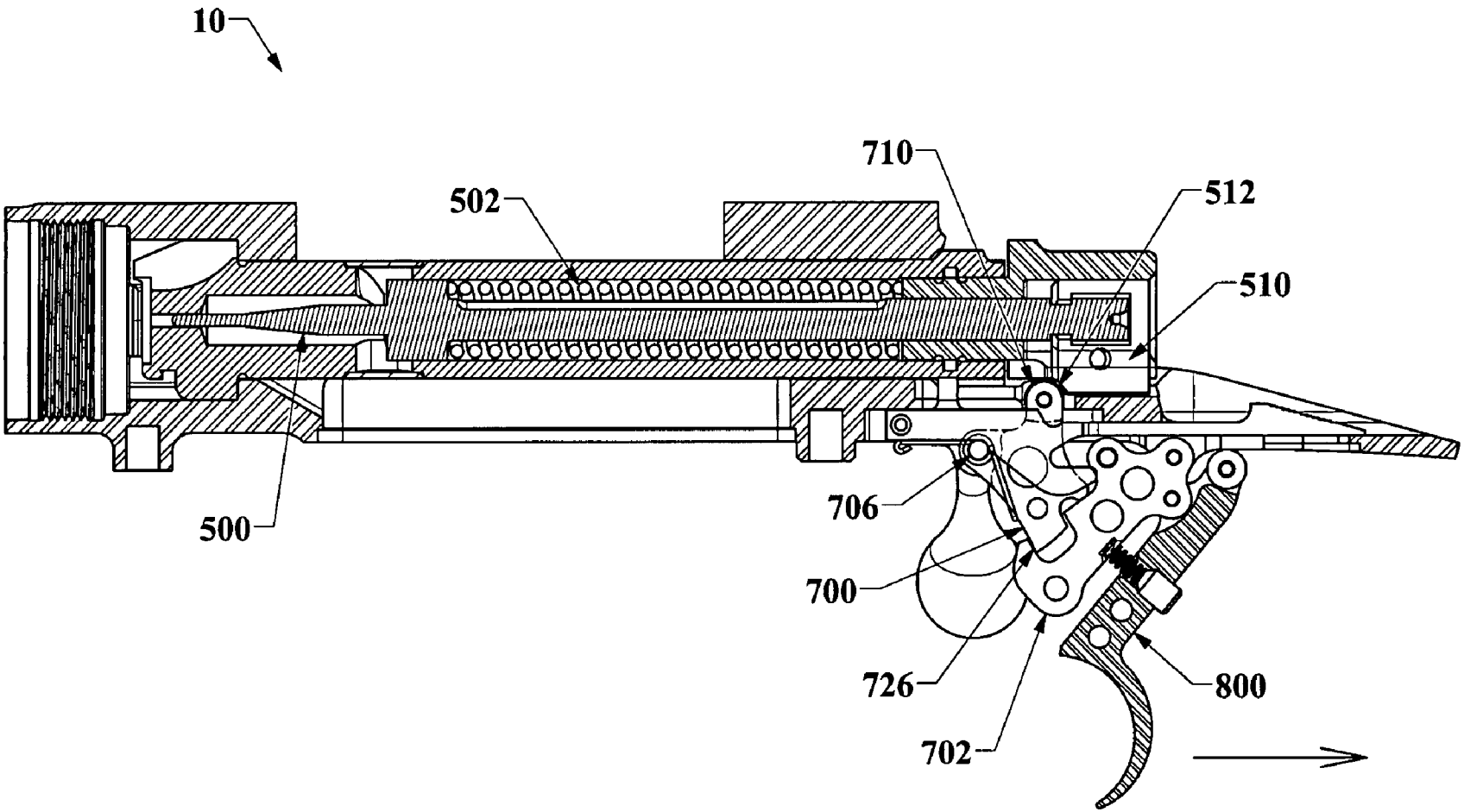
FIG. 10A is a view of a firearm before the firearm is fired in accordance with certain embodiments of the present invention.
Figure 10B:
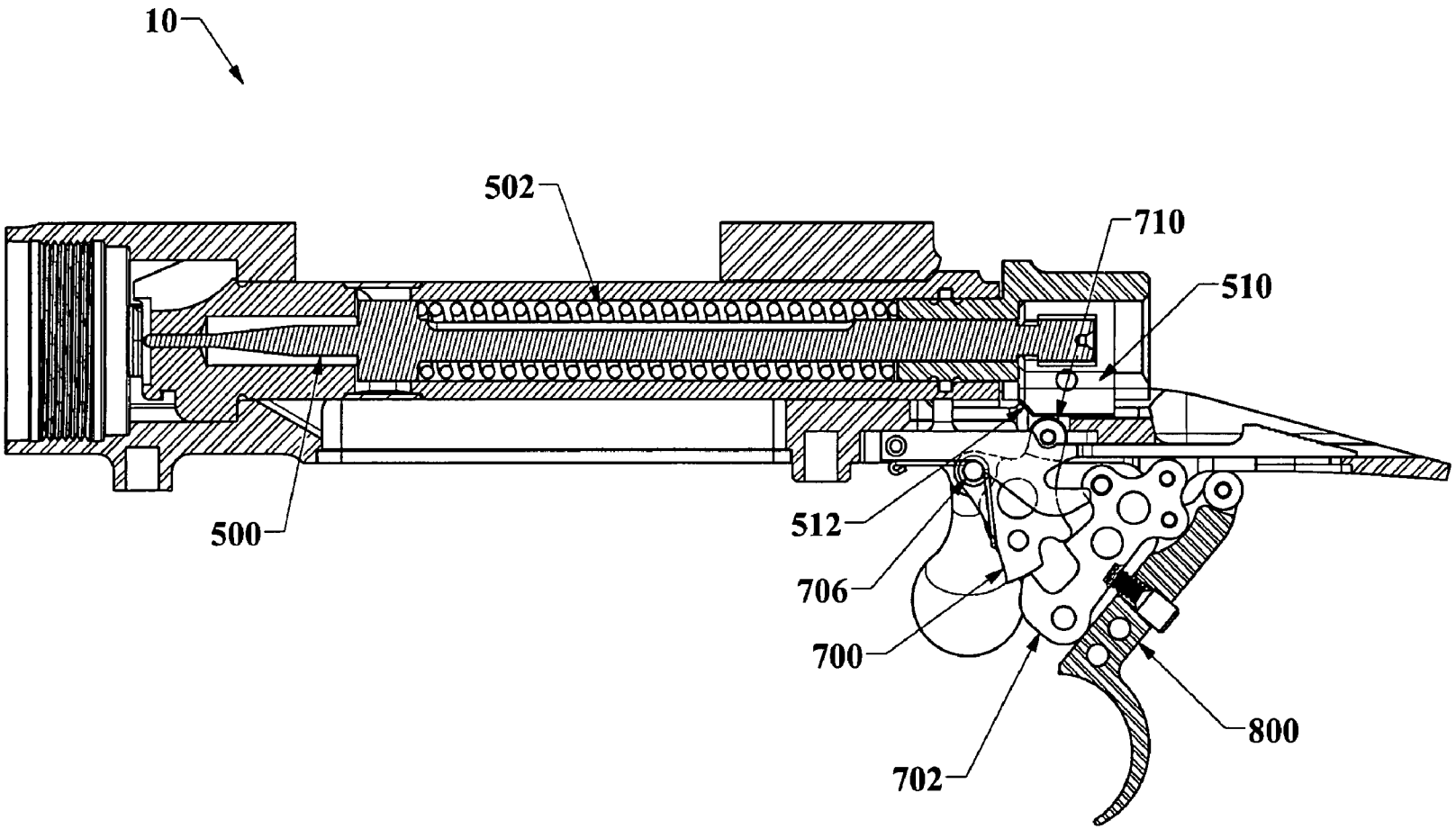
FIG. 10B is a view of a firearm after the firearm is fired in accordance with certain embodiments of the present invention.

The firing sequence of firearm 10, in accordance with certain embodiments of the present invention, will be described with reference to FIGS. 10A and 10B. FIGS. 10A and 10B respectively show a view of firearm 10 before and after discharge.

As shown in FIG. 10A, firing pin spring 502 acts to drive firing pin 500 and cocking piece 510 forward (towards barrel 20; not shown in FIGS. 10A and 10B). However, firing pin spring 502 causes cocking piece 510 to impinge upon sear roller 710. This impinging force results in a moment that tends to rotate sear 700 (sear roller 710) clockwise about sear pin 706. If sear 700 were allowed to rotate clockwise about sear pin 706, a path for the forward motion firing pin 500 would be cleared. However, sear catch 702 prevents the rotation of sear 700 about sear pin 706 until trigger 800 is pulled toward the proximal end of firearm 10 (see arrow). Pulling of trigger 800 would disengage sear catch 702 from sear 700 at sear interface 726, allowing free rotation of sear 700 about sear pin 706, and firing pin 500 would be driven forward to complete a firing sequence, as shown in FIG. 10B.

Figure 11A:
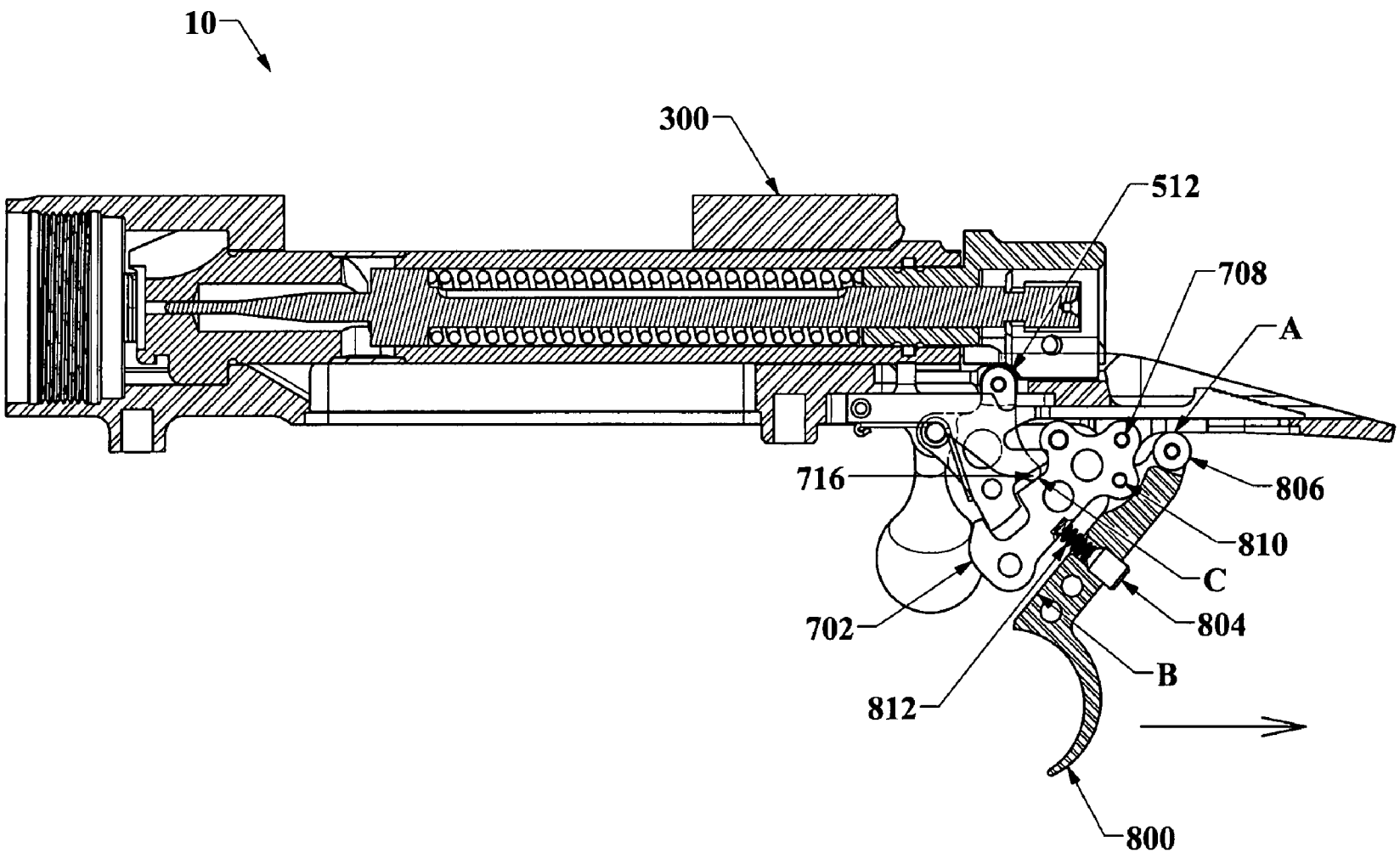
FIG. 11A is a view of a firearm before the firearm is fired in accordance with certain embodiments of the present invention.
Figure 11B:
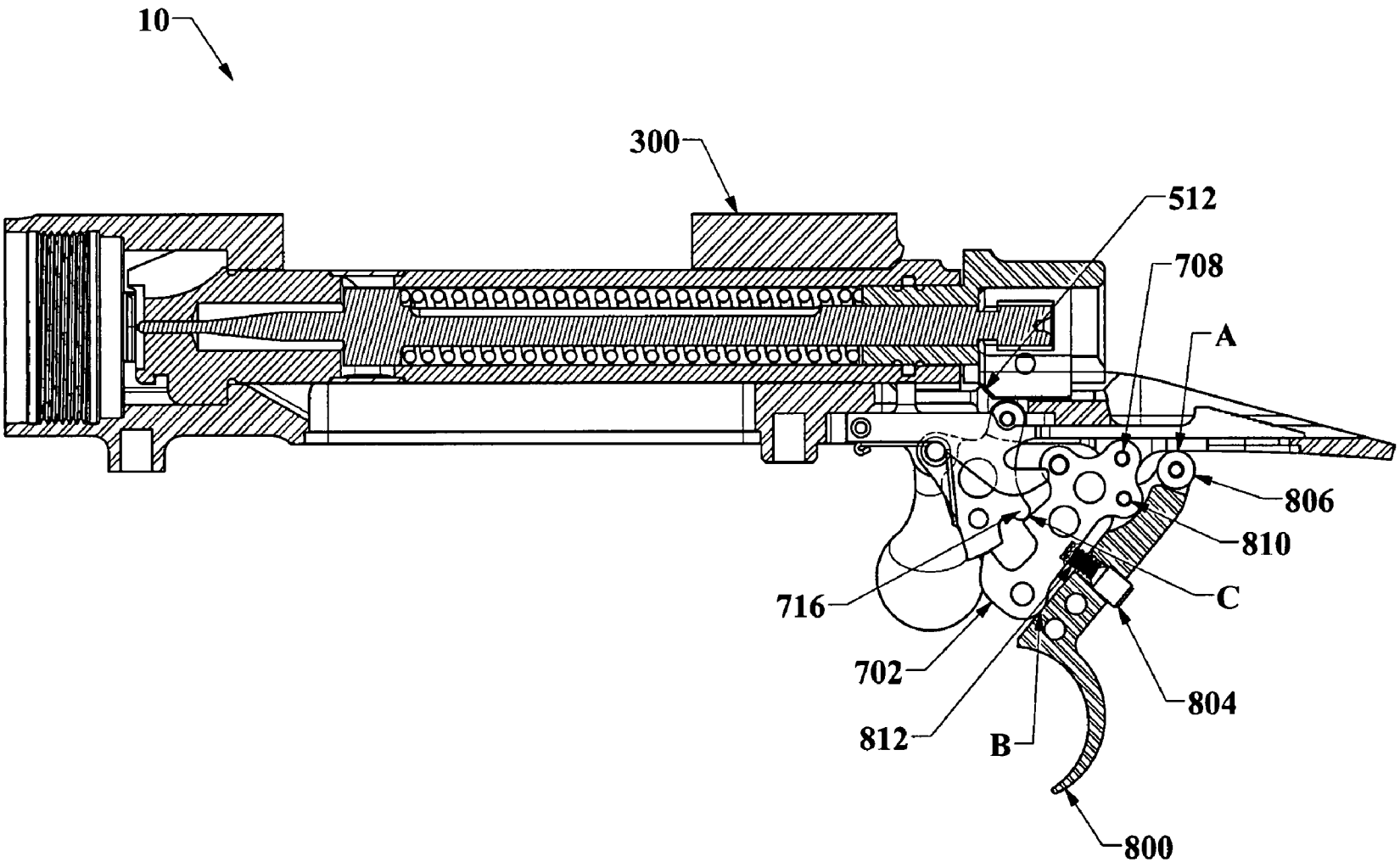
FIG. 11B is a view of a firearm after the firearm is fired in accordance with certain embodiments of the present invention.

As illustrated in FIG. 11A, trigger roller 806 rolls on the underside of receiver 300 at point A preventing the excessive counter-clockwise rotation of trigger 800 about trigger pin 810. Trigger spring 812 acts to push trigger 800 and sear catch 702 apart at point B and acts to maintain contact between trigger roller 806 and receiver 300 at point A as well as acting to maintain contact between sear lobe 716 and sear catch 702 at point C. This contact between sear lobe 716 and search catch 702 at point C may prevent the excessive clockwise rotation of sear catch 702 about sear catch pin 708 due to the action of the trigger spring 812. Trigger set screw 804 can adjust the force required to pull trigger 800 since it is capable of adjusting the length of trigger spring 812. Upon pulling trigger 800, trigger 800 and sear catch 702 rotate with respect to one another about trigger pin 810 and come together at point B, as shown in FIG. 11B.

To summarize the firing sequence (see FIGS. 10A, 10B, 11A, and 11B), upon pulling trigger 800, trigger 800 and sear catch 702 rotate with respect to one another about trigger pin 810 and come together at point B against the force of trigger spring 812. This, in effect, disengages sear catch 702 from sear 700 at sear interface 726, allowing for the clockwise rotation of sear 700 about sear pin 706. The clockwise rotation of sear 700 about sear pin 706 clears a path for the forward motion of firing pin 500, which is pushed by firing pin spring 502. As such, sear 700 is no longer in contact with sear catch 702 at sear interface 726 after the clockwise rotation of sear 700. In addition, the edge 512 of cocking piece 510 no longer impinges upon sear roller 710.

3. Reset Sequence

Figure 12A:
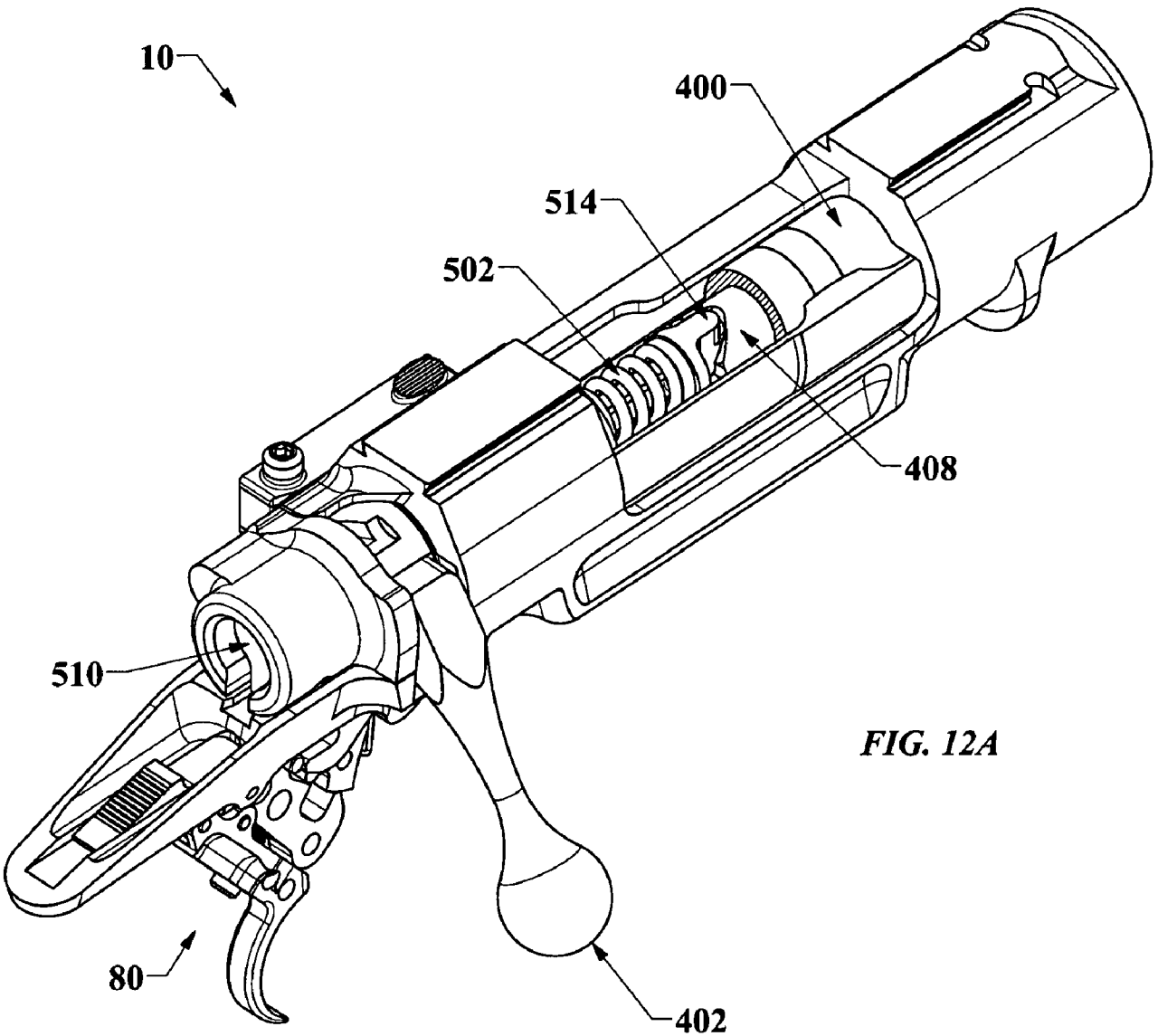
FIG. 12A is a view of a firearm after the firearm has been discharged and before the bolt assembly is rotated to initiate a reset sequence in accordance with certain embodiments of the present invention.
Figure 12B:
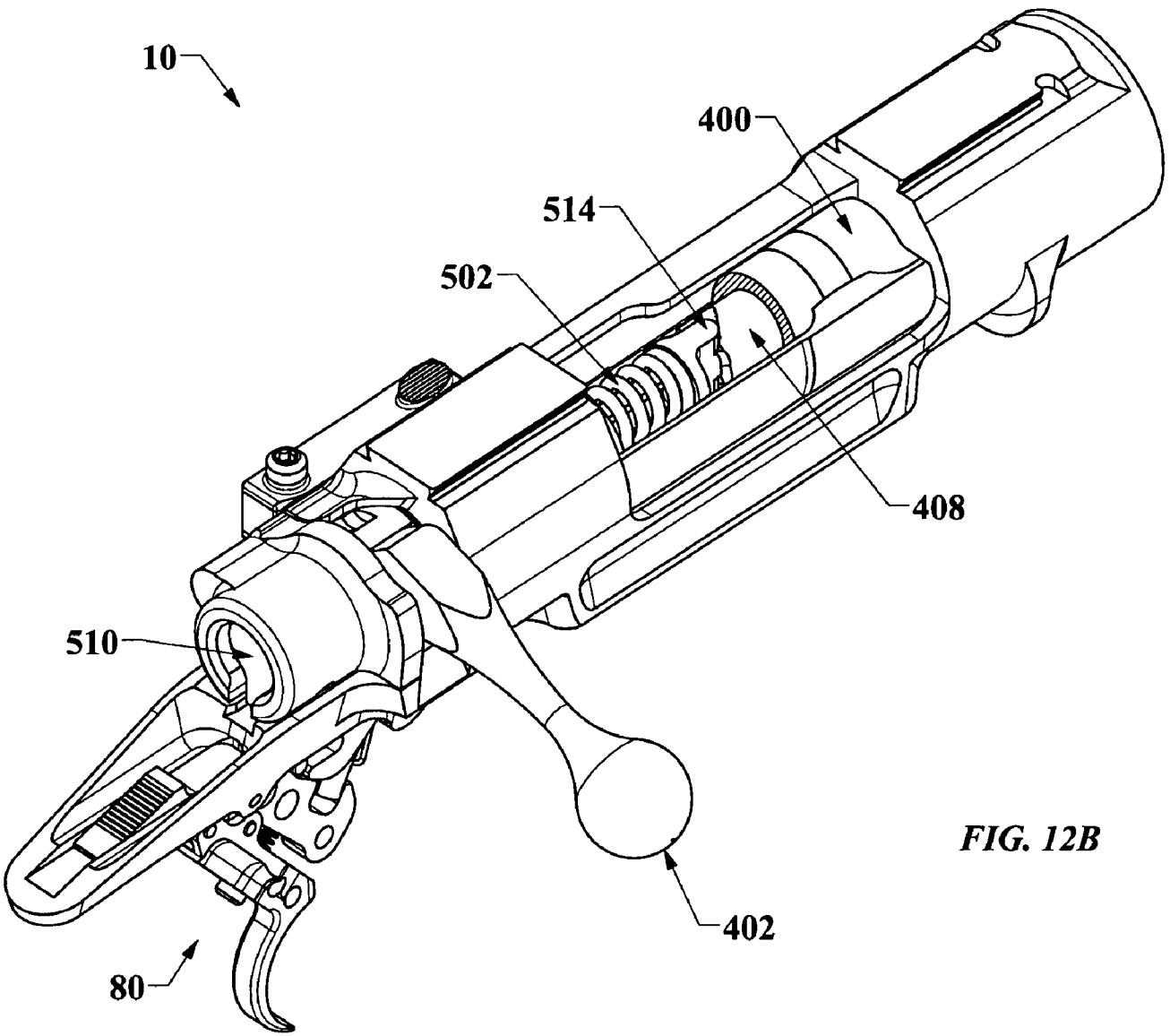
FIG. 12B is a view of a firearm showing a rotation of a bolt assembly during a reset sequence in accordance with certain embodiments of the present invention.
Figure 12C:
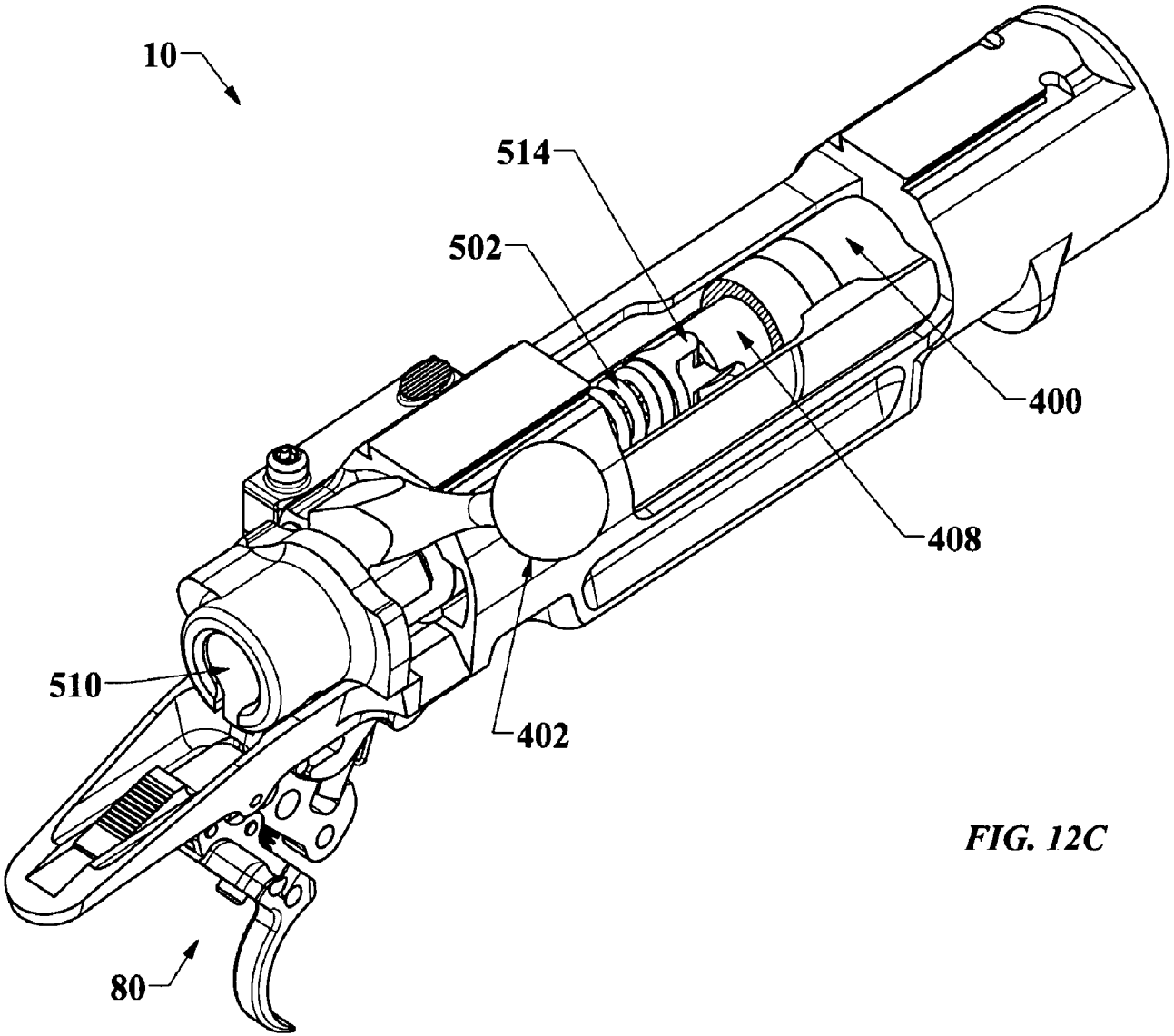
FIG. 12C is a view of a firearm showing a bolt assembly near the end of its rotation during a reset sequence in accordance with certain embodiments of the present invention.

FIGS. 12A, 12B, and 12C show the reset sequence of firearm 10 in accordance with certain embodiments of the present invention. As shown, to reset trigger assembly 80 after firearm 10 has been fired, bolt knob 402 can be lifted to rotate bolt 400 about its longitudinal axis. Upon rotation of bolt 400, firing pin cam 408 may engage firing pin cam lug 514, driving firing pin 500 and cocking piece 510 rearward against firing pin spring 502.

Figure 12D:
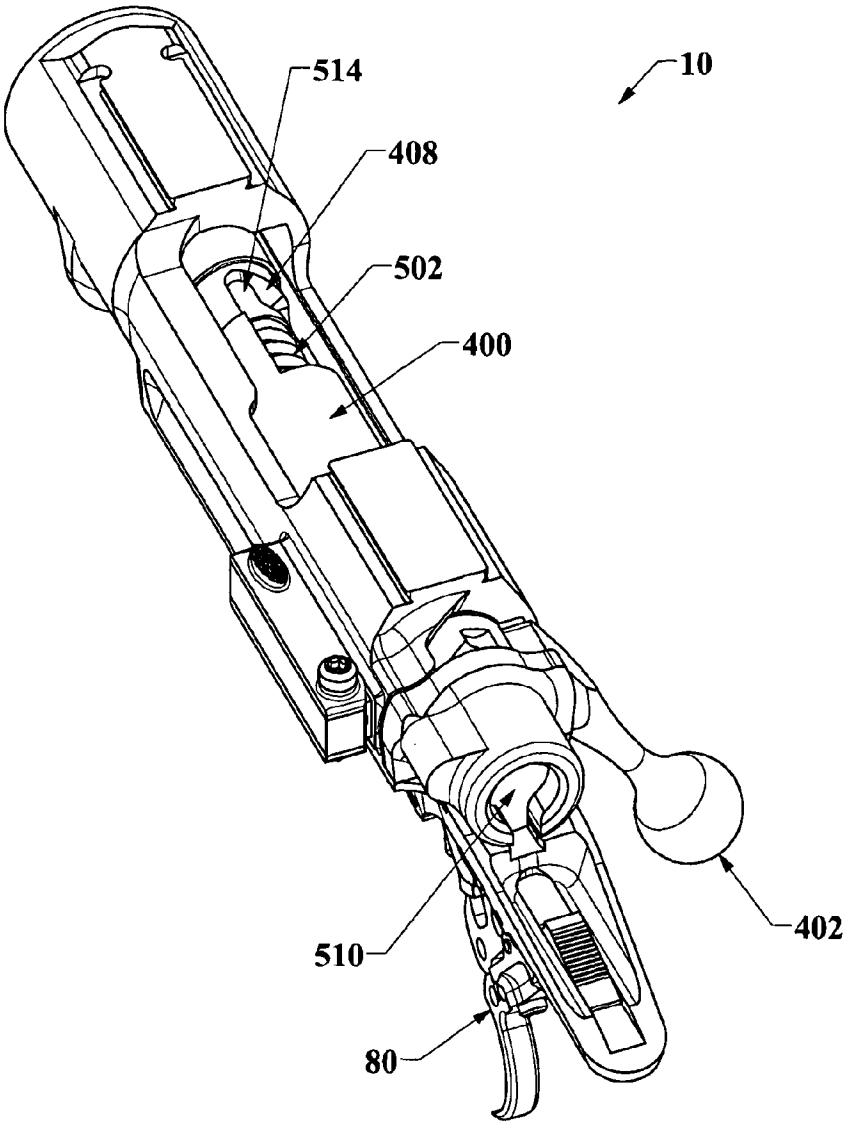
FIG. 12D is a view of a firearm after the firearm has been discharged and before the bolt assembly is rotated to initiate a reset sequence in accordance with certain other embodiments of the present invention.
Figure 12E:
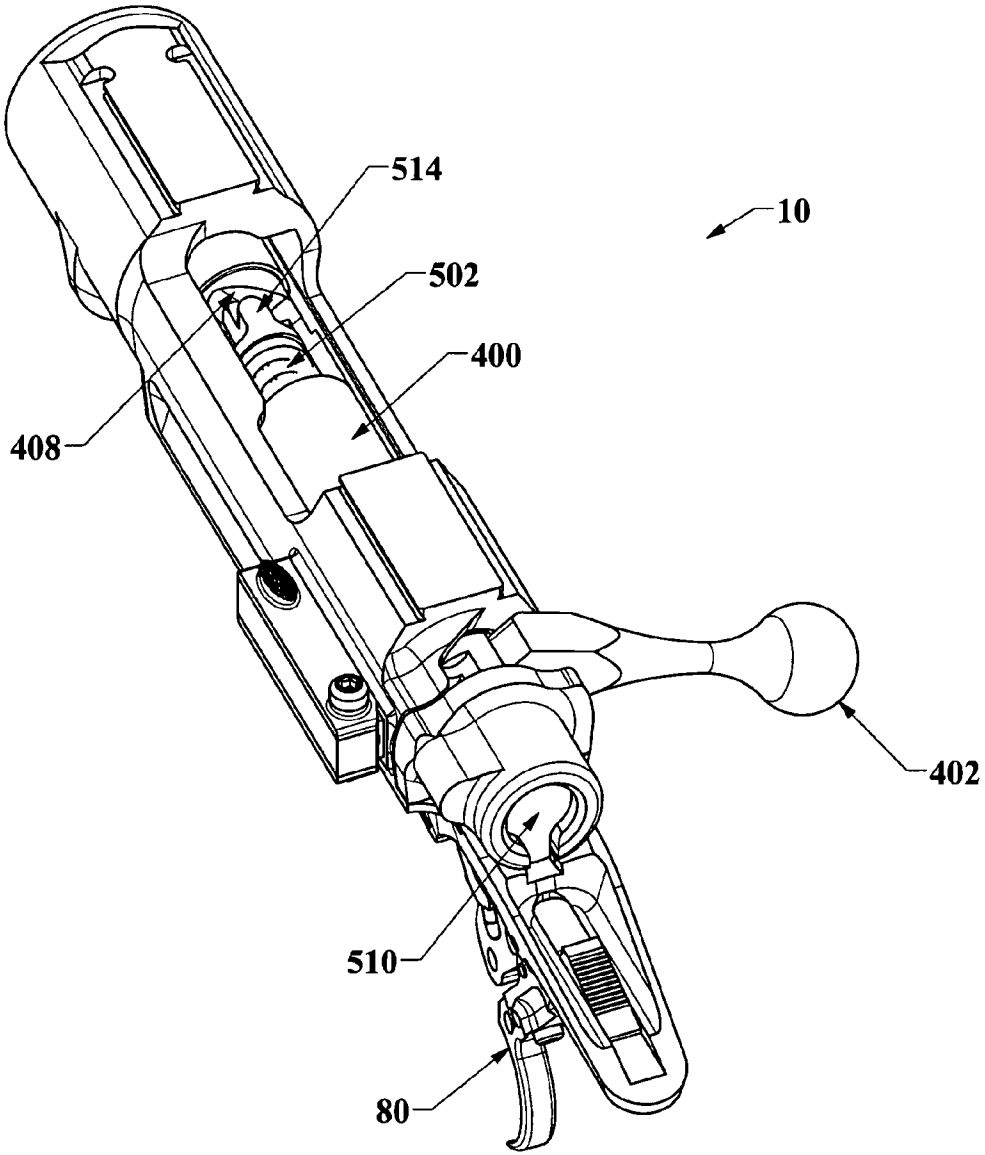
FIG. 12E is a view of a firearm showing a rotation of a bolt assembly during a reset sequence in accordance with certain other embodiments of the present invention.
Figure 12F:
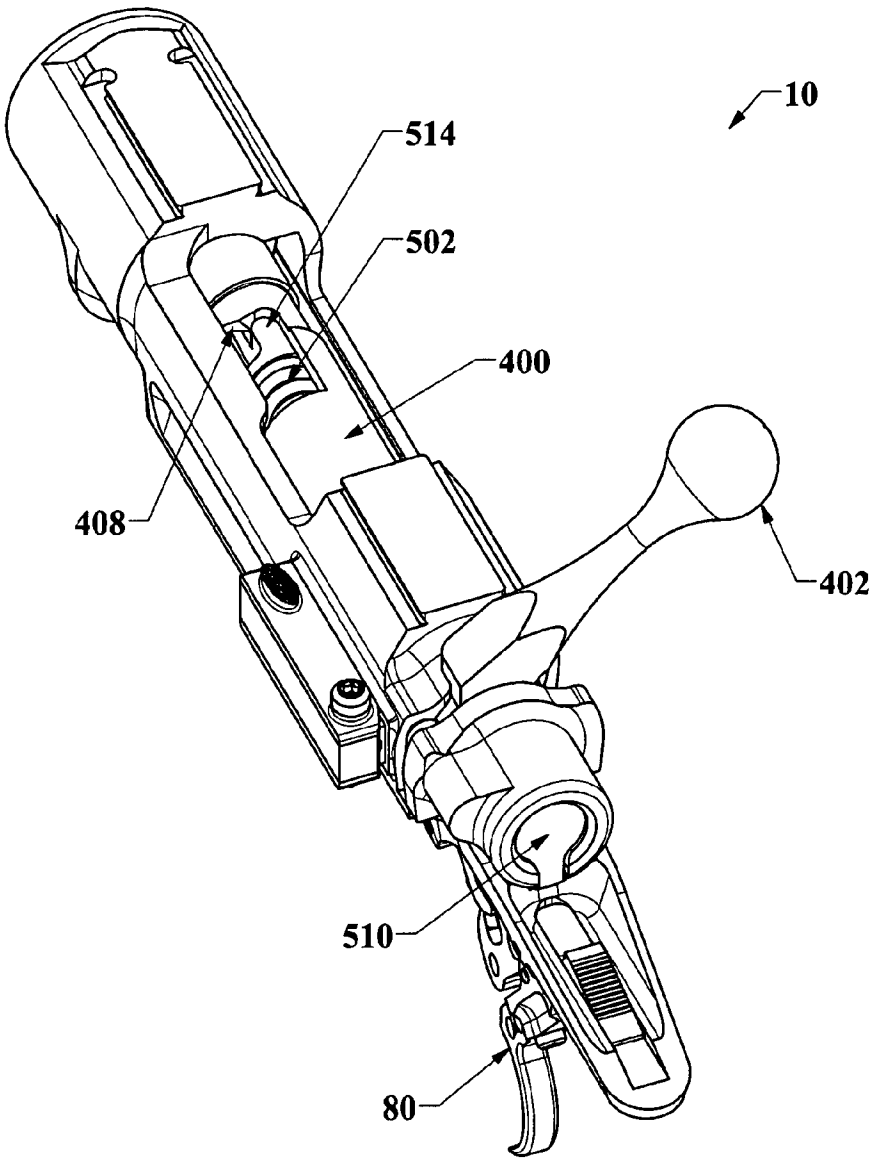
FIG. 12F is a view of a firearm showing a bolt assembly near the end of its rotation during a reset sequence in accordance with certain other embodiments of the present invention.

FIGS. 12D, 12E, and 12F show the reset sequence of firearm 10 in accordance with certain other embodiments of the present invention when firing pin cam 408 is integrated into bolt 400. As described above, to reset trigger assembly 80 after firearm 10 has been fired, bolt knob 402 can be lifted to rotate bolt 400 about its longitudinal axis. Upon rotation of bolt 400, firing pin cam 408 may engage firing pin cam lug 514, driving firing pin 500 and cocking piece 510 rearward against firing pin spring 502.

Figure 13A:
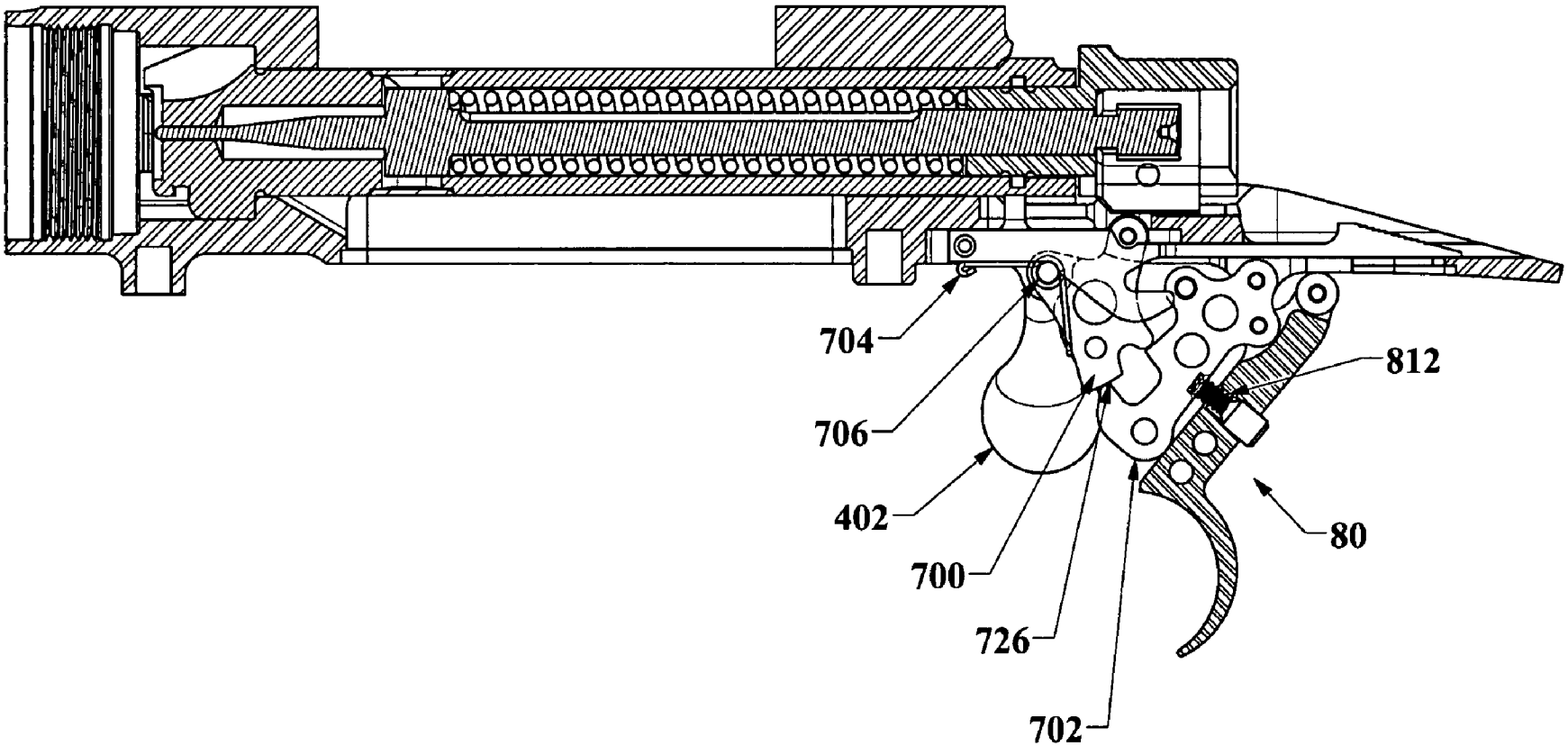
FIG. 13A is a side view of a firearm after the firearm has been discharged and before the bolt assembly is rotated to initiate a reset sequence in accordance with certain embodiments of the present invention.
Figure 13B:
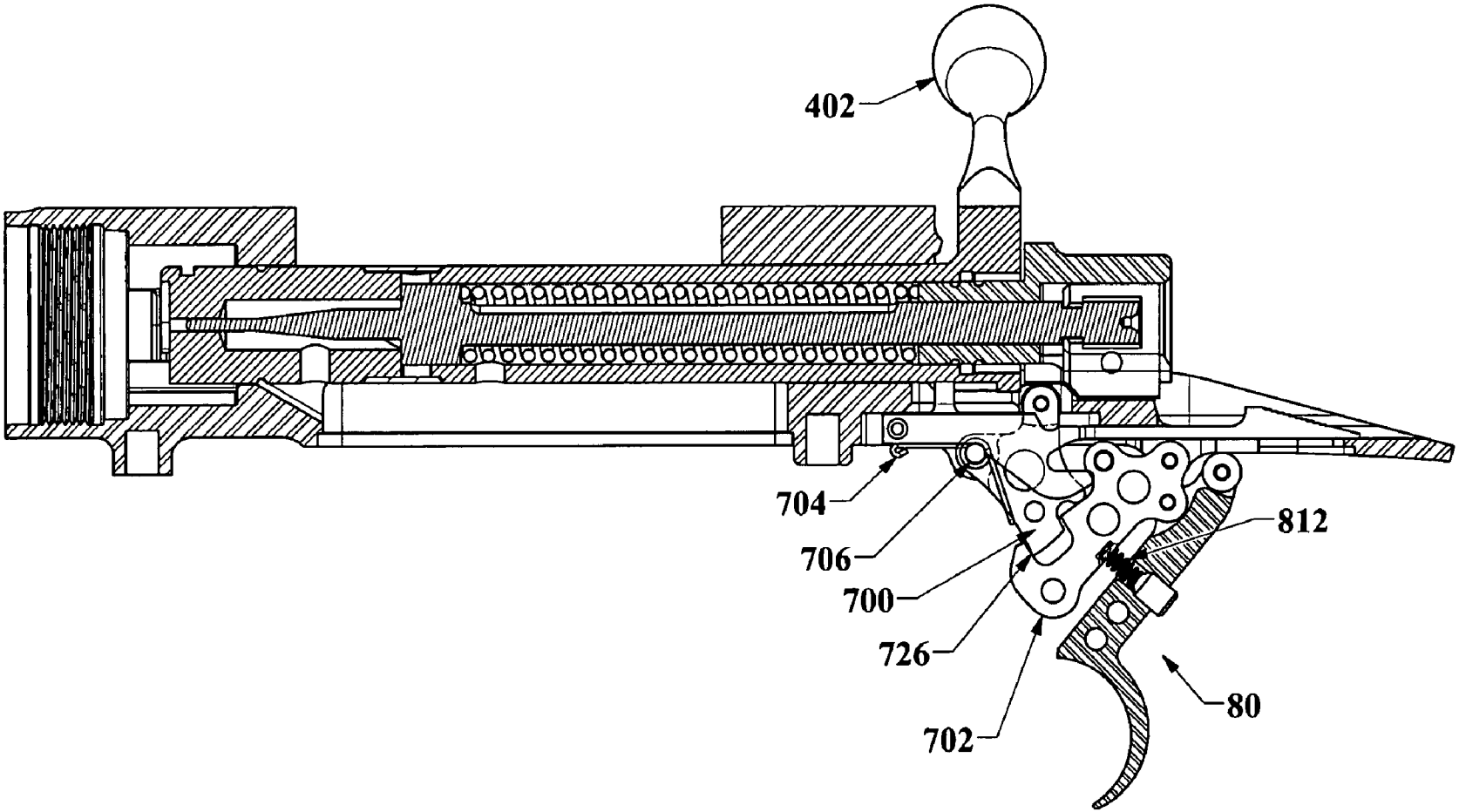
FIG. 13B is a side view of a firearm showing a bolt assembly near the end of its rotation during a reset sequence in accordance with certain embodiments of the present invention.

As shown in FIGS. 13A and 13B, such rotation of bolt knob 402 may allow sear return spring 704 to rotate sear 700 in a counter-clockwise direction about sear pin 706 until sear 700 is engaged by sear catch 702 at sear interface 726.

Sear catch 702 may be driven into engagement with sear 700 by the action of trigger spring 812. At this point, bolt knob 402 may be rotated downward to the position shown in FIG. 13C and the reset sequence of trigger assembly 80 can be considered to be complete.

Figure 13C:
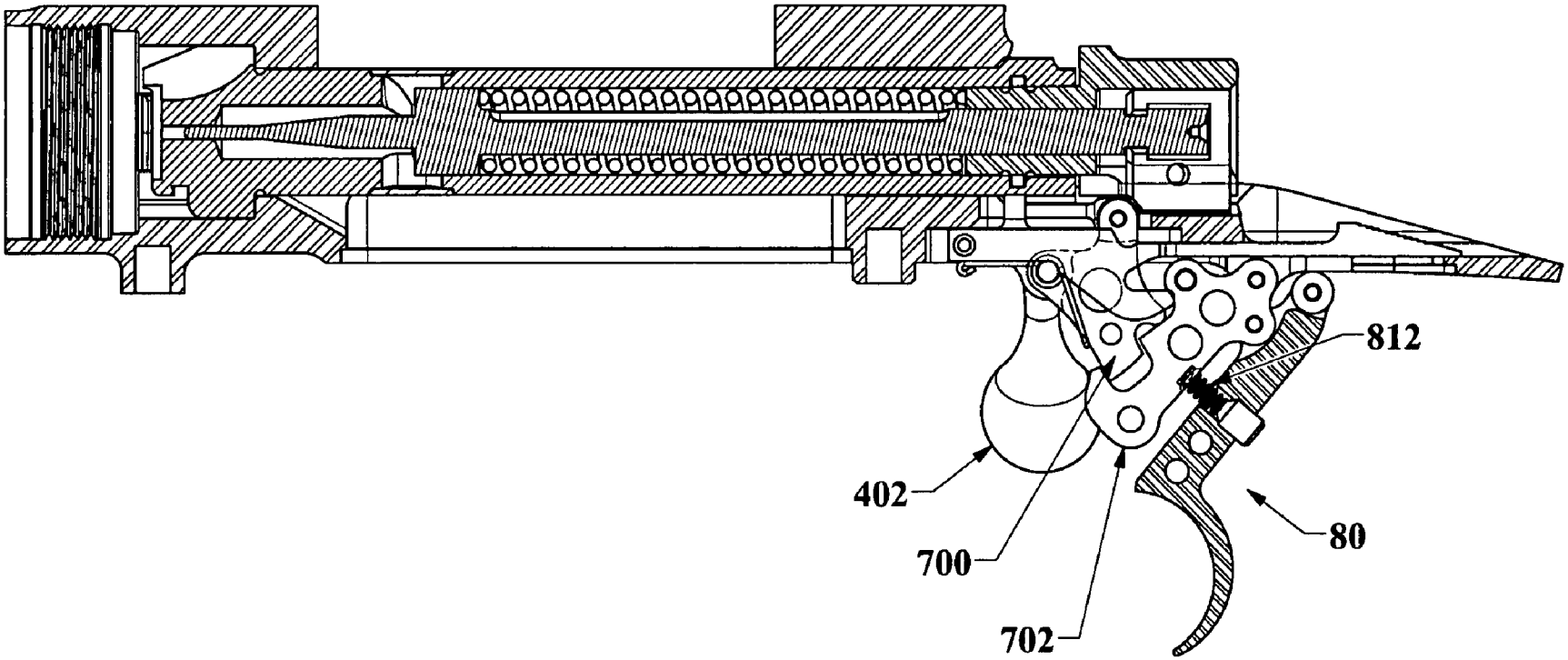
FIG. 13C is a side view of a firearm showing a completed reset sequence in accordance with certain embodiments of the present invention.

Firearm 10, shown in FIG. 13C, after the completion of the reset sequence is commonly referred to as being "cocked." In particular, the position of the trigger after a firearm has been "cocked" or reset may be referred to as a set position.

Figure 14:
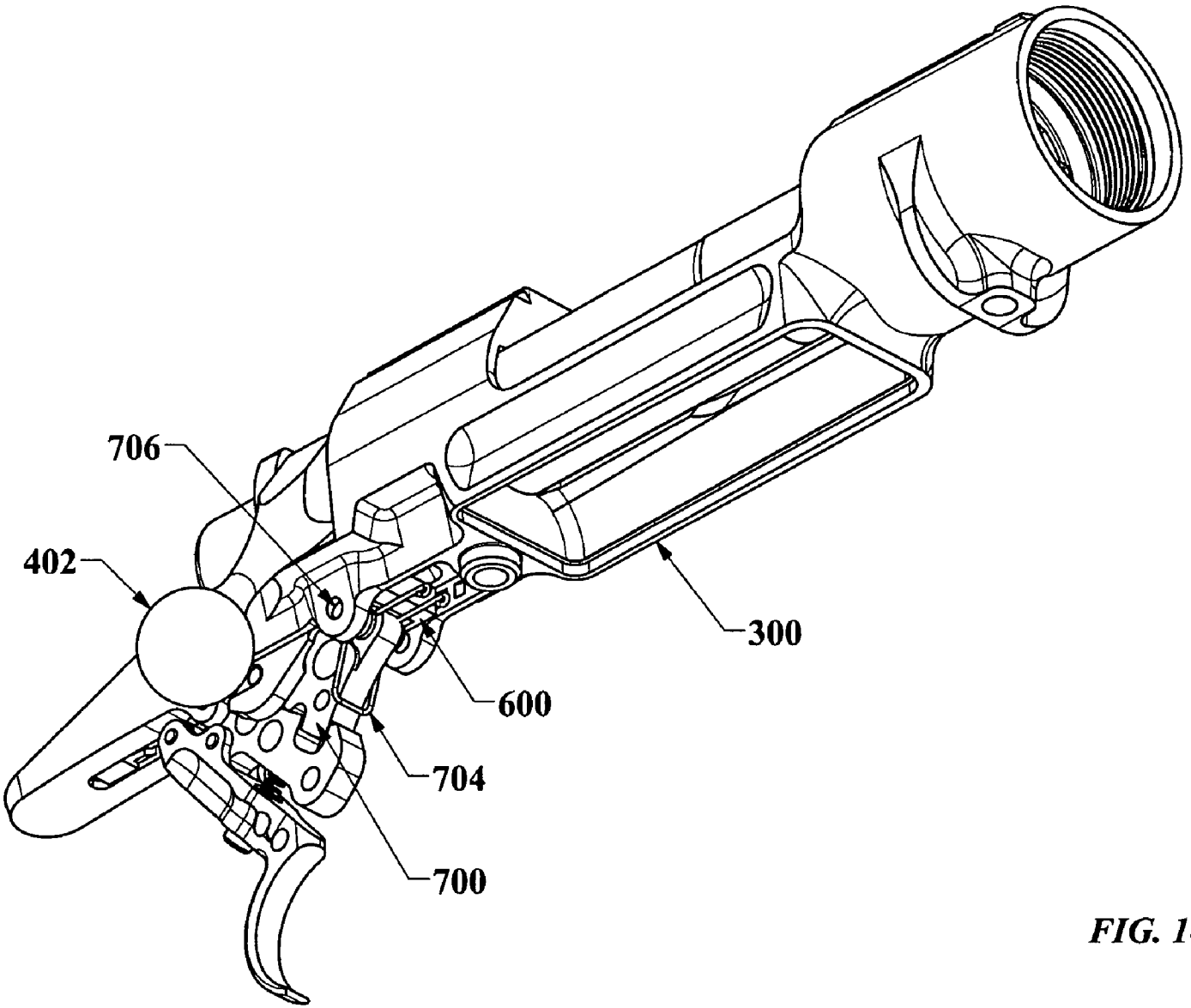
FIG. 14 is a view of a firearm showing how a sear assembly, a bolt assembly, a trigger assembly, a safety assembly, and a receiver assembly may be configured with each other in accordance with certain embodiments of the present invention.

As shown in FIG. 14, sear return spring 704 is a double torsion spring and is pinned to receiver 300 by sear pin 706 so as to straddle sear 700 and impinge upon both sear 700 and the underside of safety 600.

4. The Safety

Safety assembly 60 may be in one of three positions. As shown in FIGS. 5A, 6A, 6B, and 9, detents 306 and safety detent ball 604 are capable of providing tactile feedback to a shooter, and the location of safety 600 can easily be discerned. In certain embodiments, safety 600 may have three positions 4 mm apart from each other.

Figure 15A:
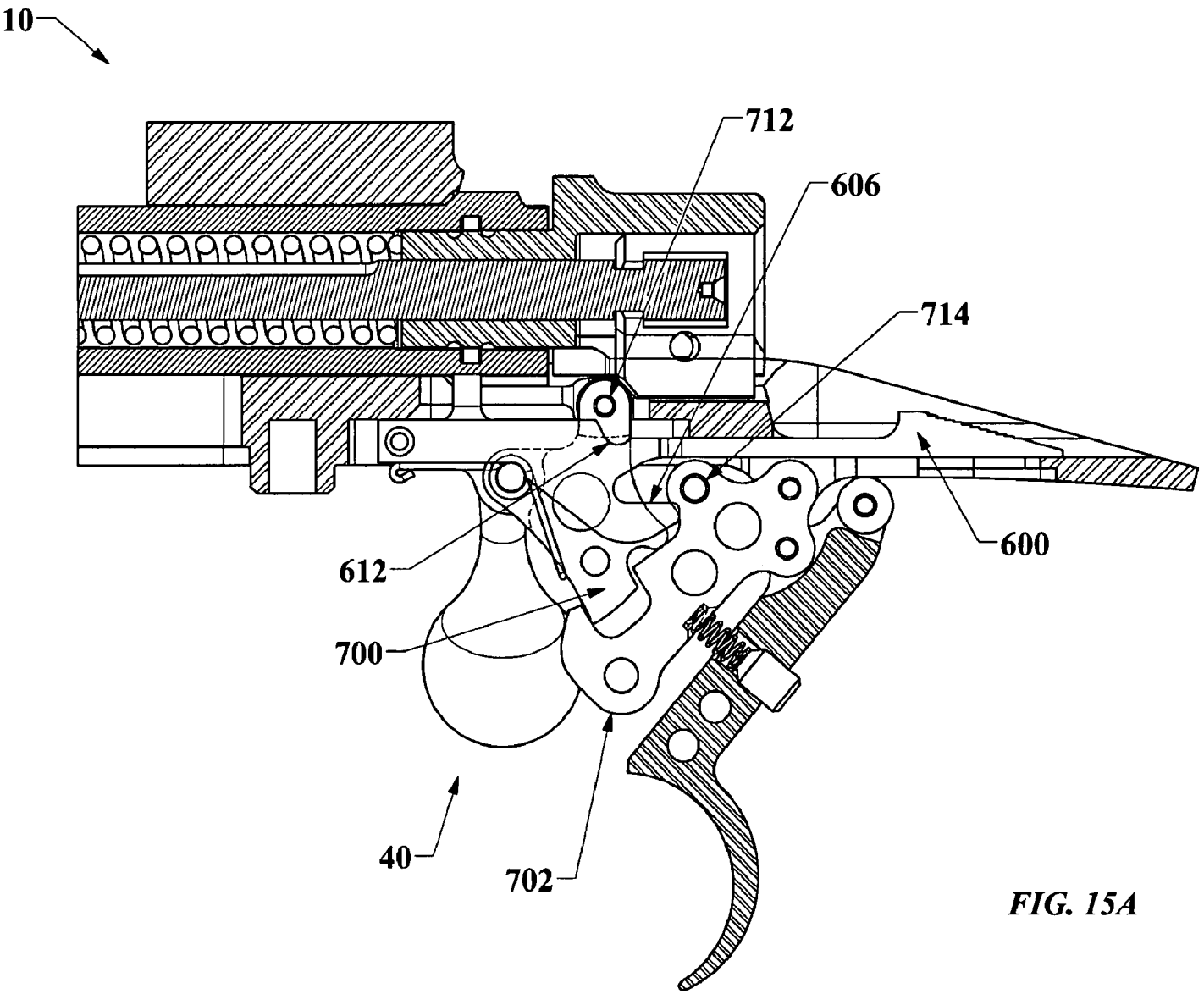
FIG. 15A is a side view of a firearm showing a first position of a safety allowing the rotation of both the bolt and sear assembly in accordance with certain embodiments of the present invention.

FIG. 15A shows a partial view of firearm 10 with safety 600 in a disengaged position. In this first position, safety 600 does not obstruct the movement of sear roller pin 712 and allows sear 700 to rotate in a clockwise direction. In addition, safety hook 606 does not obstruct the movement of sear catch safety pin 714 and allows the counter-clockwise rotation of sear catch 702. In this first position, sear roller pin 712 may drop into sear roller pin clearance cut 612 when sear 700 has rotated in a clockwise direction after firing firearm 10 (see for e.g. FIGS. 10A and 10B). Therefore, the first position can allow a shooter to discharge firearm 10 as well as manipulate bolt assembly 40 to either load or unload firearm 10.

Figure 15B:
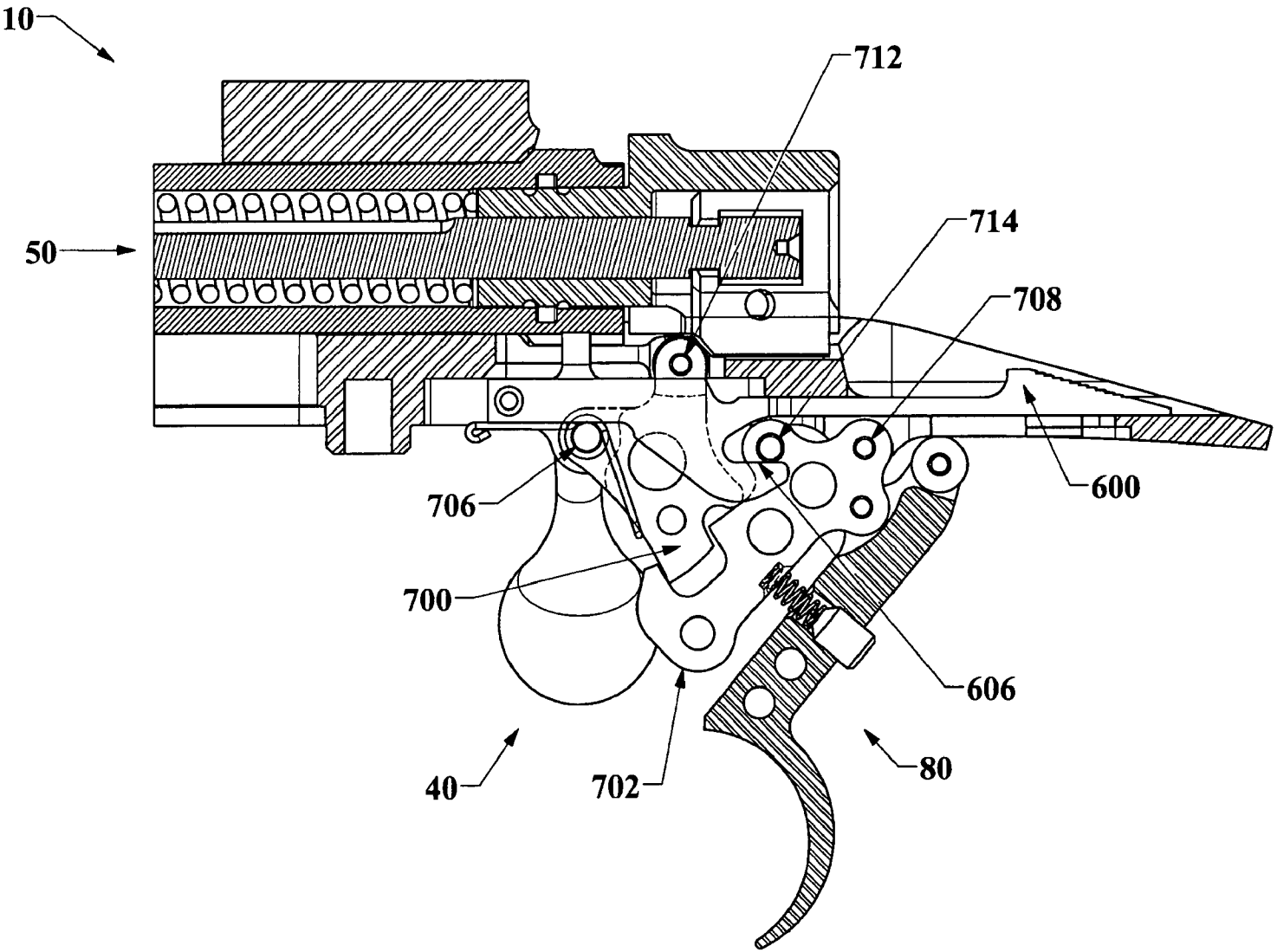
FIG. 15B is a side view of a firearm showing a second position of a safety preventing the rotation of a sear assembly while allowing the rotation of a bolt assembly in accordance with certain embodiments of the present invention.

FIG. 15B shows a partial view of firearm 10 with safety 600 in a first engaged position. In this second position, safety 600 can prevent the movement of trigger assembly 80 but allow the rotation of bolt assembly 40. Safety 600 engages sear assembly 70 preventing the motion of all parts of trigger assembly 80 towards the proximal end of firearm 10 that would otherwise tend to release firing pin assembly 50 as safety hook 606 engages sear catch safety pin 714 and prevents the rotation of sear catch 702 about sear catch pin 708. Safety 600 also prevents the clockwise rotation of sear 700 that would otherwise release firing pin assembly 50 by obstructing the downward movement of sear roller pin 712, which occurs when sear 700 rotates in a clockwise direction about sear pin 706. As such, the second position will allow a shooter to manipulate bolt assembly 40 for purposes of either loading or unloading firearm 10 while safety 600 maintains sear assembly 70 and trigger assembly 80 in a safe configuration.

Figure 15C:
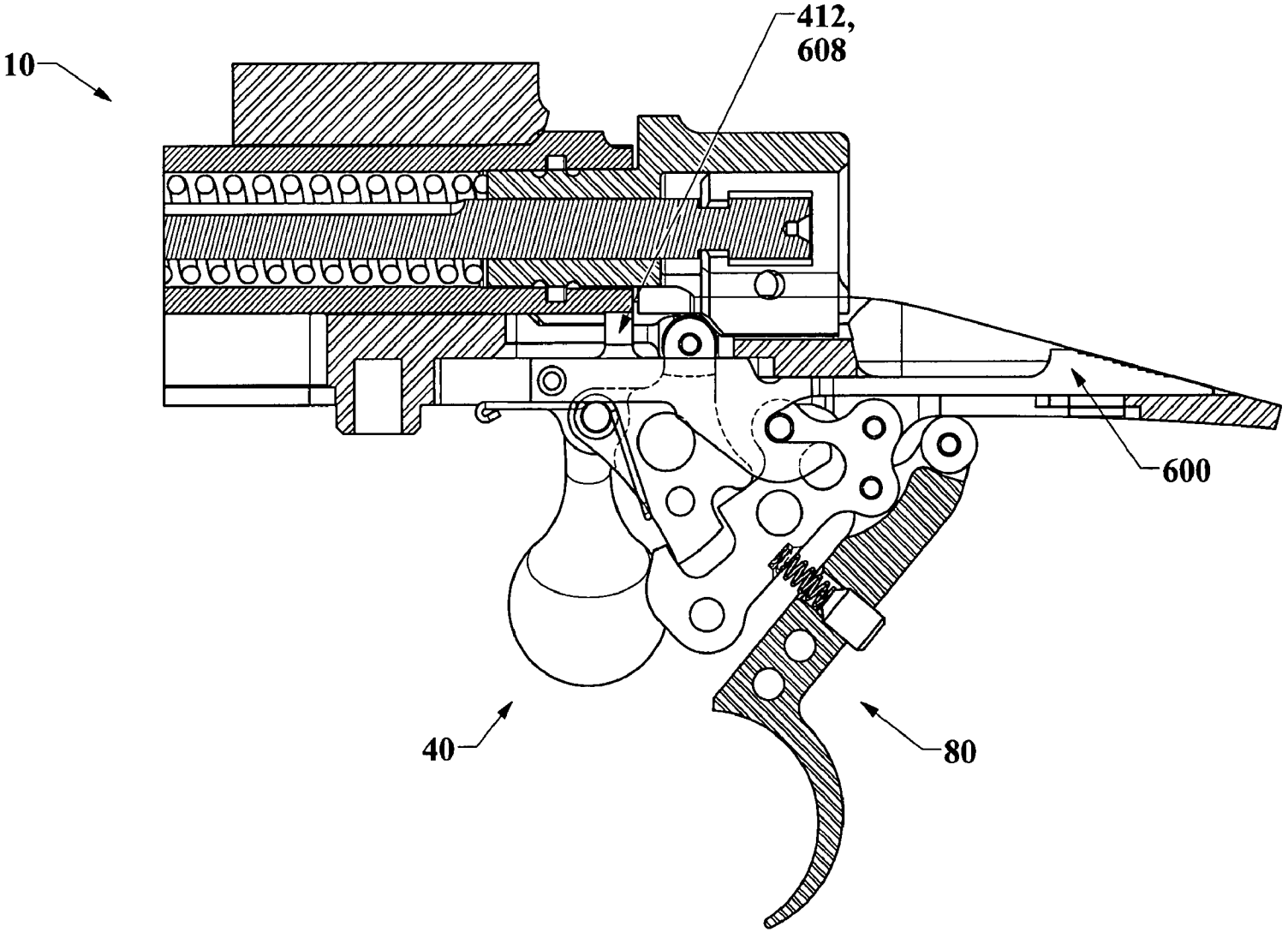
FIG. 15C is a side view of a firearm showing a third position of a safety preventing the rotation of both the bolt and sear assembly in accordance with certain embodiments of the present invention.

FIG. 15C shows a partial view of firearm 10 with safety 600 in a second engaged position. In this third position, safety 600 can prevent the movement of sear assembly 70 and trigger assembly 80 as well as prevent the rotation of bolt assembly 40. Safety 600 can prevent the movement of sear assembly 70 and trigger assembly 80, as described above. Furthermore, safety 600 can prevent the rotation of bolt assembly 40 as safety lug 608 can engage safety lug slot 412 and can prevent the rotation of bolt assembly 40 about its longitudinal axis.

5. Analysis

A trigger mechanism and a firearm in accordance with the present invention affords at least the following advantageous properties: a lightweight trigger pull, a nearly imperceptible trigger pull distance, and a large sear engagement between sear 700 and sear catch 702 may be provided, as described below.

Figure 16:
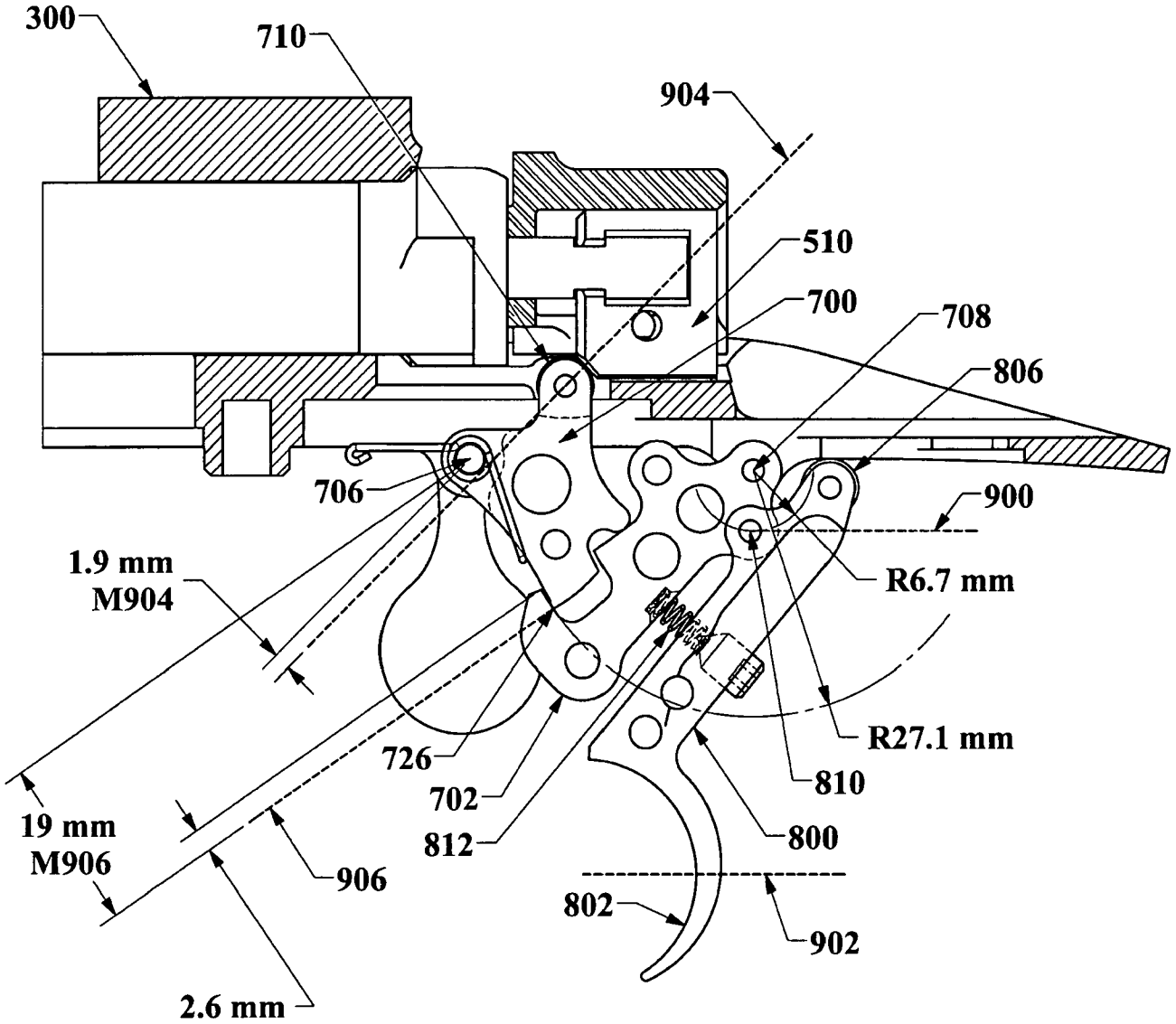
FIG. 16 is a side view of a firearm showing the various forces acting on the various components of the firearm in accordance with certain embodiments of the present invention.

FIG. 16 shows the proximal end portion of firearm 10 in accordance with certain embodiments of the present invention. In one embodiment of the present invention, as illustrated by way of FIG. 16, sear engagement 726 is approximately 2.6 mm. In addition, the distance between the pivot point of sear catch pin 708 and sear interface 726 is about 27.1 mm and is approximately four times greater than the distance between sear catch pin 708 and trigger pin 810, which is about 6.7 mm. As shown, trigger pin 810 acts as the pivot point of trigger 800. Therefore, in the embodiment shown in FIG. 16, trigger pin 810 may move only 0.6 mm to the right (see line 900) to completely disengage sear catch 702 from sear 700 at sear interface 726. Trigger 800 will pull trigger pin 810 through this distance, and because of the geometric relationship between sear catch pin 708, trigger pin 810, and trigger roller 806, the resulting motion at trigger shoe 802 closely approximates the movement at trigger pin 810. Thus, a shooter only perceives the slightest movement (0.6 mm) of trigger shoe 802 to the right along a nearly straight line (see line 902).

Because trigger 800 moves a distance that is only one-fourth that of the distance moved by sear catch 702 with respect to sear 700 at sear interface 726, the force required to overcome the friction force at sear interface 726 and pull trigger 800 to the right is approximately four times that of the friction force at sear interface 726 if the effects of trigger spring 812 and friction at various pivot points are ignored.

The four-fold increase of trigger pull force relative to the friction force at sear interface 726 may be mitigated by using a rolling element (sear roller 710) between sear 700 and cocking piece 510, as described below.

As shown in FIG. 16, cocking piece 510 may be shaped so that the force exerted by cocking piece 510 acts along line of action 904 and may pass within a very short distance of sear pin 706. Similarly, sear 700 and sear interface 726 may be shaped so that the force exerted by sear 700 at sear interface 726 acts along line of action 906. Therefore, in the present embodiment, the moment arm of line of action 906 about sear pin 706 ($M_{906}$) is approximately ten times larger than the moment arm of line of action 904 about sear pin 706 ($M_{904}$). Therefore, line of action 906 has a mechanical advantage over line of action 904. Thus, the magnitude of the force acting along line of action 906 required to maintain static equilibrium of sear 700 is approximately one-tenth that of the force acting along line of action 904 (ignoring small effects of sear return spring 704 and the friction at sear pin 706 and sear roller pin 712). Therefore, the small force in line of action 906 results in very little friction at sear interface 726.

As such, trigger assembly 80 of the present invention safely provides for a large amount of sear engagement and a lightweight, short, and nearly linear trigger pull in a single stage design. This is made possible by the use of a rolling element (or a low friction element) at the interface between sear 700 and cocking piece 510 to mitigate the effect of friction between sear 700 and cocking piece 510. Thus, the friction force between sear 700 and sear catch 702 (sear interface 726) can accordingly be minimized. Such low friction force at sear interface 726 allows the possibility of maintaining a large and safe overlap at sear interface 726 while enabling a shooter to disengage sear catch 702 from sear 700 with only the slightest movement of trigger 800 and with a lightweight trigger pull.

It should also be noted that a small trigger pull distance may be afforded by the four-bar-linkage action of a trigger mechanism in accordance with certain embodiments of the present invention. The location of pivot point of trigger 800 at trigger pin 810 with respect to the location of the pivot point of sear catch 702 at sear catch pin 708 coupled with trigger roller 806 may provide a small trigger pull distance.

Additional modifications and equivalent substitutions may be performed without departing from the spirit of the present invention. For example, the distance between the pivot point of sear catch pin 708 and sear interface 726, the distance between sear catch pin 708 and trigger pin 810 (the pivot point of trigger 800), and the distance for trigger pin 810 to move to completely disengage sear catch 702 from sear 700 may all be adjusted accordingly to adjust the trigger pull forces and trigger pull distance as desired.

As such, it is within the scope of the present invention to provide a trigger mechanism and a firearm having a range of sear engagement and trigger pull distances. For example, the ratio of sear engagement to trigger pull distance may be greater than or equal to 0.5 and less than or equal to 10.0. For example, the ratio of sear engagement to trigger pull distance may be greater than or equal to 1.0 and less than or equal to 7.5. In certain preferred embodiments, the ratio of sear engagement to trigger pull distance may be greater than or equal to 2.0 and less than or equal to 5.0. In other certain preferred embodiment, the ratio of sear engagement to trigger pull distance may be greater than or equal to 3.0 and less than or equal to 4.0.

Figure 17:
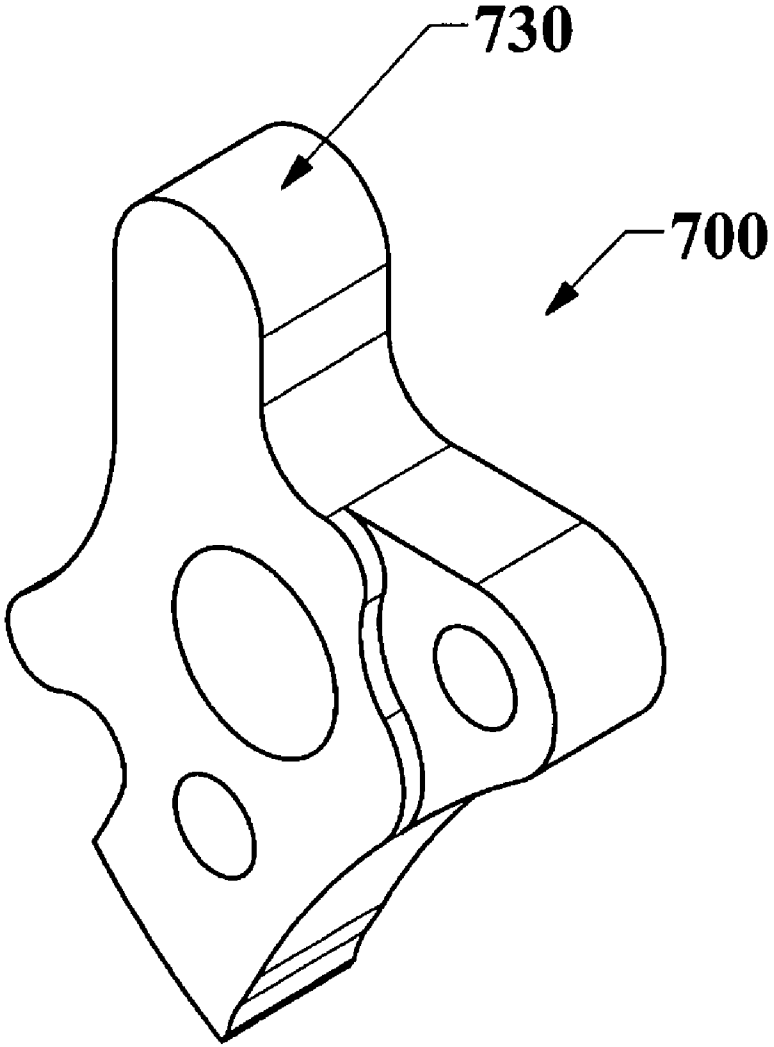
FIG. 17 is a view of a sear having a low friction coating on an element that obstructs the motion of a cocking piece in accordance with certain embodiments of the present invention.

Moreover, other embodiments of the invention may utilize fixed elements (i.e. no rollers) that have very low friction between or on sear 700 and cocking piece 510. For example, sear 700 may be shaped without a sear roller as shown in FIG. 17 and a region 730, which impinges upon cocking piece 510 may be coated with one or more materials having a low coefficient of friction. Alternatively, cocking piece 510 may be coated with one or more materials having a low coefficient of friction. Moreover, both sear 700 and cocking piece 510 may be coated with one or more materials having a low coefficient of friction. For example, materials having a coefficient of friction below 0.3, or 0.2, or 0.1 may be utilized. For example, a fluoropolymer such as TEFLON may be utilized.

Furthermore, sear 700 and sear catch 702 may be coated to further reduce the friction force between sear 700 and sear catch 702. For example, sear 700 and sear catch 702 may be coated with low friction coatings such as fluoropolymers. An example of a fluoropolymer may be TEFLON.

In addition, rather than using trigger roller 806, a fixed element having a low coefficient of friction may be utilized. For example, materials having a coefficient of friction below 0.3, or 0.2, or 0.1 may be utilized. For example, a fluoropolymer such as TEFLON may be utilized.

Figure 18A:
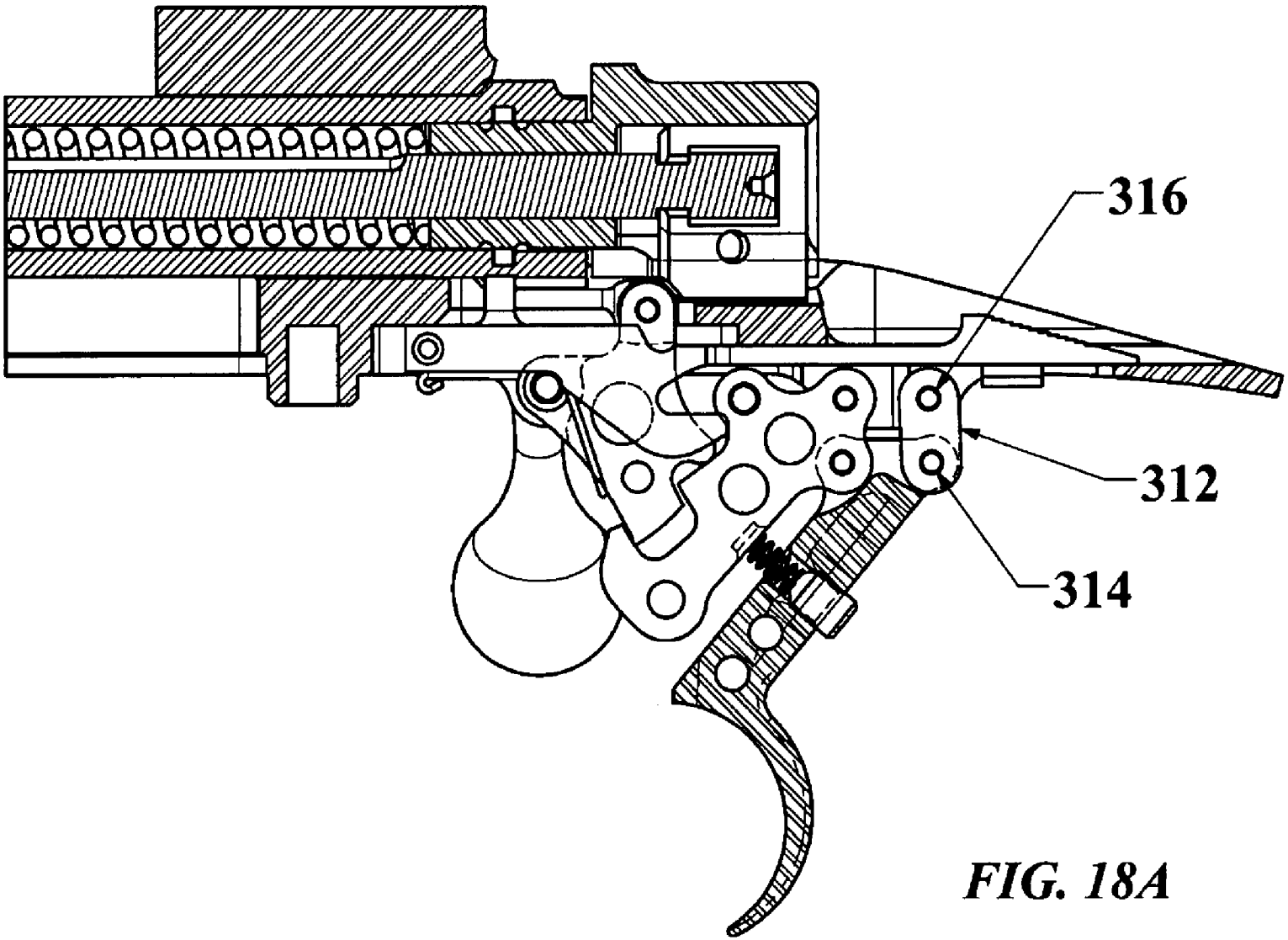
FIGS. 18A and 18B are side views of a firearm showing a trigger mechanism having a link which connects a trigger with a receiver before and after the firearm has been discharged in accordance with certain embodiments of the present invention.
Figure 18B:
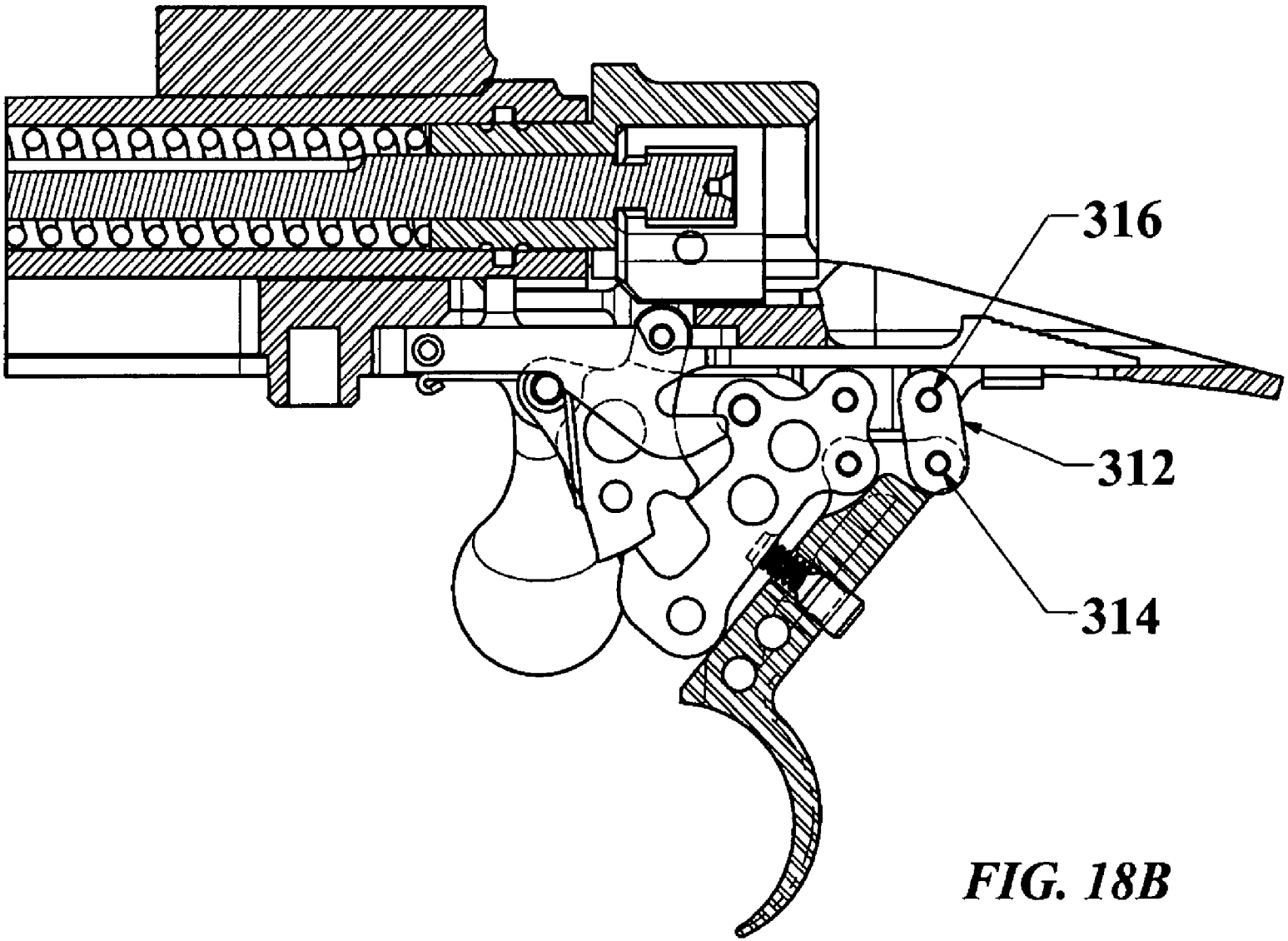

An alternative embodiment of the present invention is shown in FIGS. 18A and 18B. As illustrated, trigger roller 806 may be substituted by a trigger-receiver link 312 that connects trigger 800 with receiver 300 by trigger-receiver link pins 314 and 316. FIG. 18A shows the position of trigger mechanism before discharge and FIG. 18B shows the position of trigger mechanism after the firearm has been discharged.

Figure 19A:
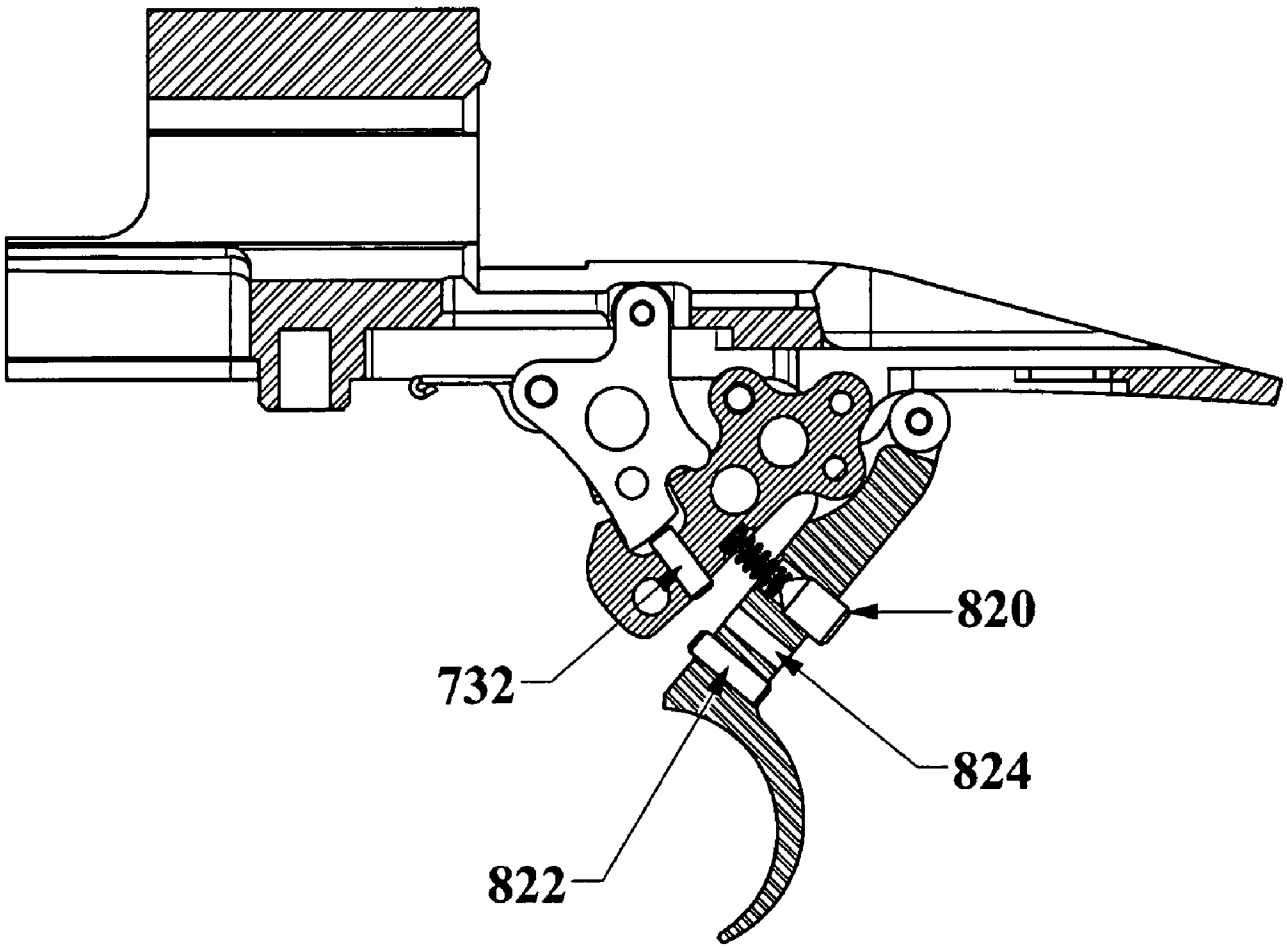
FIGS. 19A and 19B are side views of a firearm showing a trigger mechanism having adjustable screws before and after the firearm has been discharged in accordance with certain embodiments of the present invention.
Figure 19B:
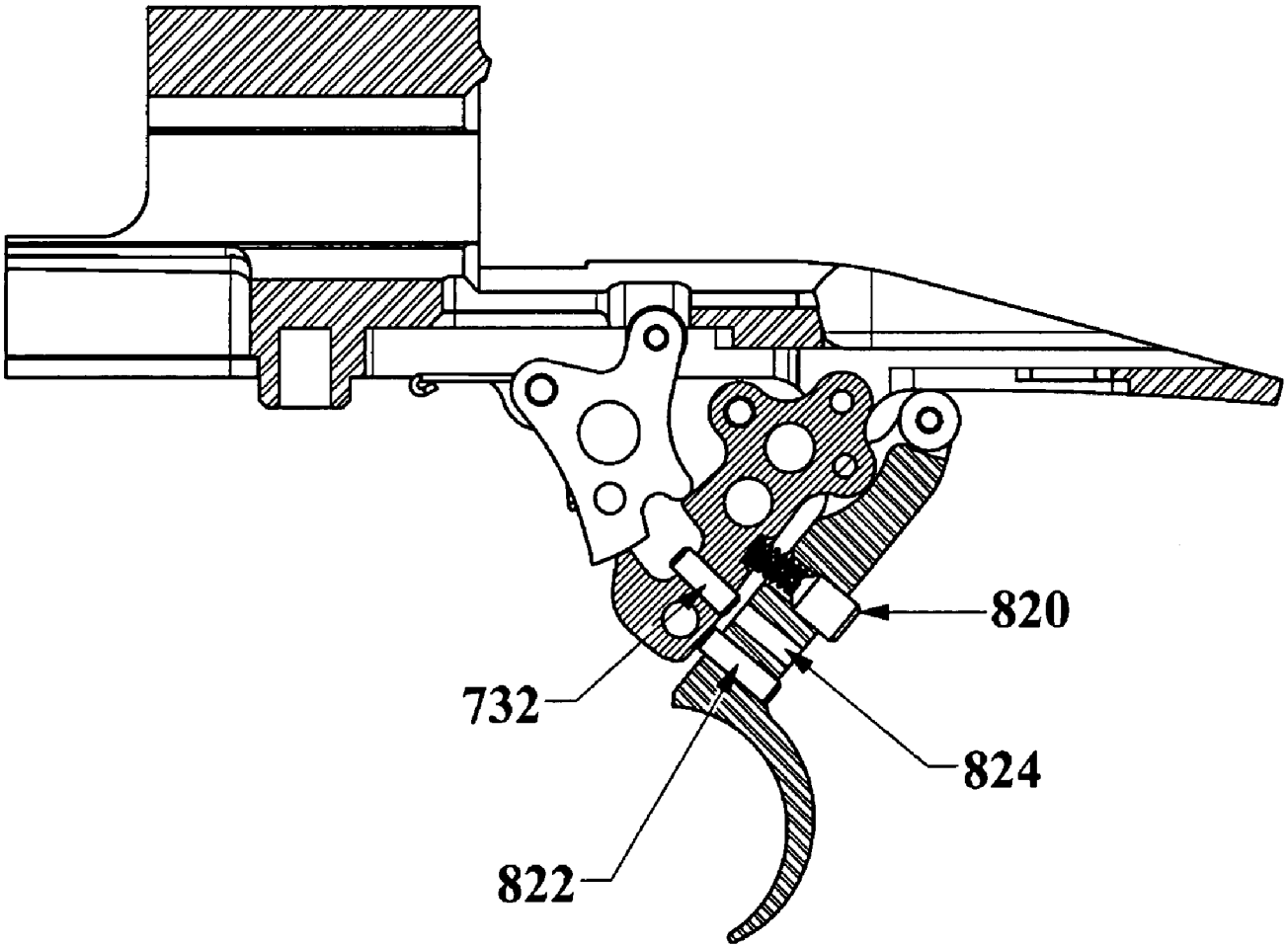

Further modifications to the various embodiments of the present invention are shown in FIGS. 19A and 19B. As illustrated, a trigger mechanism and a firearm in accordance with the present invention may contain one or more adjustable set screws capable of controlling the degree of sear engagement, trigger pull force, and/or trigger pull distance. For example, trigger spring set screw 820 may be adjusted to control the trigger pull force. Similarly, sear catch set screw 732 may be adjusted to control the sear engagement. Sear catch set screw 732 may be made readily accessible to an operator via a sear catch set screw hole 824. Moreover, sear catch set screw 732 and trigger over travel set screw 822 may be adjusted to control the trigger pull distance. Firearm 10 having set screws 732, 820, and 822 and set screw hole 824 may be designed so that sear engagement, trigger pull distance, and/or trigger pull force of firearm 10 can be adjusted as desired by an operator.

Lastly, it should be noted that many of the various components described above may be fabricated in many different suitable manners. For example, firing pin cam lugs 514 or any portion from firing pin cam lugs 514 to the distal end 50*b* of firing pin 500, shown in FIGS. 4A and 4B as a single part, may be machined as a separate components and later assembled with the remaining portion of firing pin 500. Alternatively, cocking piece 510 and firing pin 500, shown in FIGS. 4A and 4B as two discrete components to be later assembled together, may rather be machined as a single component.

Upon review of the description and embodiments of the present invention, those skilled in the art will understand that additional modifications and substitutions may be performed in carrying out the invention without departing from the essence of the invention. Thus, the invention is not meant to be limiting by the embodiments described explicitly above.

What is claimed is:

1. A firearm comprising:

a sear assembly comprising a sear and a sear roller;

a trigger assembly comprising a trigger;

a firing pin assembly comprising a cocking piece, wherein said sear assembly, said trigger assembly, and said firing pin assembly are operably connected to each other so that said sear roller obstructs the movement of said cocking piece until said trigger is pulled to a firing position; and a bolt assembly comprising an extractor collar and a bolt having a firing pin cam integrally incorporated into said bolt; wherein said firing pin assembly comprises a firing pin;

said firing pin cam is surrounded by said extractor collar to be hidden from visual observation; and said bolt assembly is capable of resetting said firearm after said firearm has been discharged.

2. The firearm as claimed in claim 1, further comprising a receiver;

said sear being connected to said receiver by a sear pin, said sear catch being connected to said receiver by a sear catch pin, and said trigger being connected to said sear catch by a trigger pin.

3. The firearm as claimed in claim 2, further comprising:

a safety assembly which comprises a safety, a ball, and a detent spring;

said ball and said detent spring being contained within said safety;

wherein said safety assembly is operably connected to said sear assembly so that said safety assembly can be adjusted to prevent accidental discharge of said firearm.

4. The firearm as claimed in claim 3, wherein said receiver comprises detents capable of providing tactile feedback to a user through said safety assembly.

5. The firearm as claimed in claim 1, further comprising a receiver, wherein said sear is rotatably coupled to said receiver, a sear catch of the sear assembly is rotatably coupled to said receiver, and said trigger assembly moves with respect to said sear catch as said sear catch moves with respect to said sear.

6. The firearm as claimed in claim 1, wherein said trigger is movable between a set position and the firing position, the trigger is rotatably coupled to a sear catch of the sear assembly and restrained by a receiver of said firearm such that said sear catch slides along and disengages a surface of said sear when said trigger is moved between said set position and said firing position.

7. The firearm as claimed in claim 6, wherein said trigger assembly includes a trigger roller configured to travel along said receiver as said trigger moves between said set position and said firing position.

8. The firearm of claim 1, wherein a surface of the sear generally overlaps the sear engaging surface.

9. A firearm comprising:

a sear assembly comprising a sear and a sear catch;

a trigger assembly comprising a trigger, said sear assembly and said trigger assembly are operably connected to each other to provide a ratio of a sear engagement to a trigger pull distance that is greater than or equal to 0.5 and less than or equal to 10, said sear engagement being a length of a contact path along a sear engaging surface of said sear catch contacted by said sear so as to disengage said sear from said sear catch, said trigger pull distance being a distance traveled by said trigger from a set position to a position which causes said sear and said sear catch to be disengaged from each other;

a receiver; wherein said trigger assembly further comprises a trigger roller; and said sear is connected to said receiver by a sear pin, said sear catch is connected to said receiver by a sear catch pin, said trigger is connected to said sear catch by a trigger pin, and said trigger roller is in contact with said receiver.

10. The firearm as claimed in claim 9, wherein the ratio of said sear engagement to said trigger pull distance is greater than or equal to 1.0 and less than or equal to 7.5.

11. The firearm as claimed in claim 9, wherein the ratio of said sear engagement to said trigger pull distance is greater than or equal to 2.0 and less than or equal to 5.0.

12. The firearm as claimed in claim 9, wherein the ratio of said sear engagement to said trigger pull distance is greater than or equal to 3.0 and less than or equal to 4.0.

13. The firearm as claimed in claim 9, said firearm further comprising:

a firing pin assembly which comprises a cocking piece; wherein an element obstructs the movement of said cocking piece until said trigger is pulled to a position which causes said sear and said sear catch to be disengaged from each other.

14. The firearm as claimed in claim 13, wherein said element is a sear roller.

15. The firearm as claimed in claim 13, wherein said element is a fixed element having a surface in contact with said cocking piece, said surface having a coefficient of friction less than or equal to 0.3.

16. The firearm as claimed in claim 13, wherein said element is a fixed element having a surface in contact with said cocking piece, said surface has a coefficient of friction less than or equal to 0.1.

17. A firearm comprising:

a receiver;

a sear assembly comprising a sear and a sear catch;

a trigger assembly comprising a trigger and a trigger roller; and wherein said sear is connected to said receiver by a sear pin, said sear catch is connected to said receiver by a sear catch pin, said trigger is connected to said sear catch by a trigger pin, and said trigger roller is in contact with said receiver.

18. The firearm of claim 17, wherein said sear assembly and said trigger assembly are operably connected to each other to provide a ratio of a sear engagement to a trigger pull distance that is greater than or equal to 0.5 and less than or equal to 10.0;

said sear engagement is a distance traveled by a sear engaging surface of said sear catch with respect to an opposing surface of said sear to disengage said sear from said sear catch; and said trigger pull distance being a distance traveled by a central region of said finger engagement portion of said trigger from a set position to a position which causes said sear and said sear catch to be disengaged from each other.

19. The firearm as claimed in claim 18, wherein the ratio of said sear engagement to said trigger pull distance is greater than or equal to 1.0 and less than or equal to 7.5.

20. The firearm as claimed in claim 18, wherein the ratio of said sear engagement to said trigger pull distance is greater than or equal to 2.0 and less than or equal to 5.0.

21. The firearm as claimed in claim 18, wherein the ratio of said sear engagement to said trigger pull distance is greater than or equal to 3.0 and less than or equal to 4.0.

22. The firearm as claimed in claim 18, further comprising:

a firing pin assembly comprising a cocking piece; wherein an element obstructs the movement of said cocking piece until said trigger is pulled to a position which causes said sear and said sear catch to be disengaged from each other.

23. The firearm as claimed in claim 22, wherein said element is a sear roller.

24. The firearm as claimed in claim 22, wherein said element is a fixed element having a surface in contact with said cocking piece, said surface having a coefficient of friction that is less than or equal to 0.3.

25. The firearm as claimed in claim 22, wherein said element is a fixed element having a surface in contact with said cocking piece, said surface having a coefficient of friction that is less than or equal to 0.1.

26. The firearm of claim 17, further comprising:

a firing pin assembly including a cocking piece; wherein said sear assembly further comprises a sear roller, and said sear assembly, said trigger assembly, and said firing pin assembly are operably connected to each other so that said sear roller obstructs the movement of said cocking piece until said trigger is moved to a firing position.

27. A firearm comprising:

a receiver;

a sear assembly comprising a sear and a sear catch;

a trigger assembly comprising a trigger and receiver-engaging means for movably engaging said receiver, said receiver-engaging means including a trigger roller; and said sear is connected to said receiver by a sear pin, said sear catch is connected to said receiver by a sear catch pin, and said trigger is connected to said sear catch by a trigger pin.

* * * * *